US010301557B2

(12) United States Patent
Ho et al.

(10) Patent No.: US 10,301,557 B2
(45) **Date of Patent: *May 28, 2019**

(54) HIGH VISCOSITY BASE STOCK COMPOSITIONS

(71) Applicant: ExxonMobil Research and Engineering Company, Annandale, NJ (US)

(72) Inventors: Suzzy C. H. Ho, Princeton, NJ (US); Charles L. Baker, Jr., Thornton, PA (US); Shuji Luo, Basking Ridge, NJ (US); Halou Oumar-Mahamat, Belle Mead, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 176 days.

This patent is subject to a terminal disclaimer.

(21) Appl. No.: 15/332,012

(22) Filed: Oct. 24, 2016

(65) Prior Publication Data

US 2017/0137726 A1 May 18, 2017

Related U.S. Application Data

(60) Provisional application No. 62/254,753, filed on Nov. 13, 2015.

(51) Int. Cl.
*C10G 57/00* (2006.01)
*C10G 69/12* (2006.01)
(Continued)

(52) U.S. Cl.
CPC ..... *C10G 57/00* (2013.01); *C10G 50/02* (2013.01); *C10G 69/02* (2013.01); *C10G 69/126* (2013.01);
(Continued)

(58) Field of Classification Search
CPC ..... C10G 57/00; C10G 69/126; C10G 50/02; C10G 69/02; C10G 2300/304;
(Continued)

(56) References Cited

U.S. PATENT DOCUMENTS 4,913,794 A 4/1990 Le et al.
4,931,197 A 6/1990 Beck et al.
4,990,713 A 2/1991 Le et al.
5,132,478 A 7/1992 Ho et al.
(Continued)

FOREIGN PATENT DOCUMENTS

DE 2361653 A1 6/1974
EP 0620264 A2 10/1994
(Continued)

OTHER PUBLICATIONS

The International Search Report and Written Opinion of PCT/US2016/058422 dated Feb. 2, 2017.
(Continued)

*Primary Examiner* — Pamela H Weiss
(74) *Attorney, Agent, or Firm* — Scott F. Yarnell

(57) ABSTRACT

Methods are provided for producing Group I base stocks having high viscosity and also having one or more properties indicative of a high quality base stock. The resulting Group I base stocks can have a viscosity at 100° C. and/or a viscosity at 40° C. that is greater than the corresponding viscosity for a conventional Group I bright stock formed by solvent processing. Additionally, the resulting Group I base stocks can have one or more properties that are indicative of a high quality base stock.

12 Claims, 11 Drawing Sheets

(51) Int. Cl.

| | |
|---|---|
| ***C10G 50/02*** | (2006.01) |
| ***C10M 171/02*** | (2006.01) |
| ***C10M 109/02*** | (2006.01) |
| ***C10M 101/02*** | (2006.01) |
| ***C10G 69/02*** | (2006.01) |

(52) U.S. Cl.

CPC ..... *C10M 101/02* (2013.01); *C10M 109/02* (2013.01); *C10M 171/02* (2013.01); *C10G 2300/202* (2013.01); *C10G 2300/302* (2013.01); *C10G 2300/304* (2013.01); *C10G 2400/10* (2013.01); *C10M 2203/1006* (2013.01); *C10M 2203/1025* (2013.01); *C10M 2205/0285* (2013.01); *C10M 2205/173* (2013.01); *C10N 2220/021* (2013.01); *C10N 2220/022* (2013.01); *C10N 2230/02* (2013.01); *C10N 2230/10* (2013.01); *C10N 2240/04* (2013.01); *C10N 2260/02* (2013.01); *C10N 2270/00* (2013.01)

(58) Field of Classification Search

CPC ..... C10G 2300/302; C10G 2300/202; C10G 2400/10; C10G 7/00; C10G 67/02; C10M 171/02; C10M 109/02; C10M 101/02; C10M 2205/173; C10M 2205/0285; C10M 2203/1025; C10M 2203/1006; C10N 2270/00; C10N 2260/02; C10N 2240/04; C10N 2230/10; C10N 2230/02; C10N 2220/022; C10N 2220/021

See application file for complete search history.

(56) References Cited

U.S. PATENT DOCUMENTS

| | | | | |
|---|---|---|---|---|
| 5,271,825 | A | 12/1993 | Bortz et al. | |
| 5,306,416 | A | 4/1994 | Le et al. | |
| 6,660,894 | B1 | 12/2003 | Wu et al. | |
| 7,537,685 | B2 | 5/2009 | Chen et al. | |
| 2002/0117424 | A1 | 8/2002 | Drake et al. | |
| 2007/0284284 | A1 | 12/2007 | Zones et al. | |
| 2010/0036038 | A1* | 2/2010 | Rodgers | B60C 1/0008 524/445 |
| 2010/0323937 | A1 | 12/2010 | Wu et al. | |
| 2013/0217606 | A1* | 8/2013 | Wang | C10M 129/60 508/449 |
| 2013/0317265 | A1* | 11/2013 | Small | C08F 10/14 585/18 |
| 2014/0213834 | A1* | 7/2014 | Patil | C10M 107/10 585/18 |
| 2014/0378720 | A1* | 12/2014 | Wu | C08F 10/14 585/255 |

FOREIGN PATENT DOCUMENTS

| | | | |
|---|---|---|---|
| GB | 1454498 | A | 11/1976 |
| WO | 98/58972 | A1 | 12/1998 |

OTHER PUBLICATIONS

The International Search Report and Written Opinion of PCT/US2016/058424 dated Feb. 2, 2017.

The International Search Report and Written Opinion of PCT/US2016/058430 dated Feb. 2, 2017.

* cited by examiner

| Description | | CORE 2500 Group I Bright Stock | Example 1 | Example 2 | Example 3 | Example 4 |
|---|---|---|---|---|---|---|
| Derived from | | NA | Core 100 | Core 100 | Core 100 | Core 100 |
| Amount of Peroxide Added/Add Time | | | 10%/2 hrs | 30%/2 hrs | 30%/4 hrs | 60%/4 hrs |
| Hydrofinished | | NA | No | Yes | Yes | Yes |
| Viscosity @ 100°C, cSt | Kinematic Viscosity | 31.6 | 35.1 | 43.7 | 110.6 | 161.5 |
| Viscosity @ 40°C, cSt | Kinematic Viscosity | 476 | 657 | 701 | 3684 | 3702 |
| Viscosity Index | | 97 | 85 | 106 | 111 | 137 |
| Density@15.6°C, g/cc | | 0.9019 | 0.9075 | 0.8990 | 0.9147 | 0.9041 |
| Sulfur, % | ASTM D2622-1 | 1.15% | ND | 0.34% | 0.35% | 0.29% |
| Aniline Point, °C | ASTM D611 | 120.0 | 111.7 | 125.6 | 128.0 | 146.7 |
| Glass Transition Temperature Tg, °C | Differential Scanning Calorimetry (DSC) | -58.8 | ND | -69.34 | -50.40 | -61.20 |
| Crystallization Temperature Tc, °C | DSC | -6.25 | ND | -35.97 | <-60°C | <-60°C |
| Quantitative Carbon-13 NMR | | | | | | |
| % Epsilon Carbon | @ 29 - 31 ppm | 27.3% | 21.4% | 19.0% | 20.2% | 21.4% |
| % Aromatic Carbon | @ 117 – 150 ppm | 5.1% | ND | 6.0% | 7.1% | ND |

FIG. 9

| Description | | CORE 2500 Group I Bright Stock | Example 1 | Example 2 | Example 3 | Example 4 |
|---|---|---|---|---|---|---|
| Absorptivity at 226 nm | L/gcm | 11.240 | 15.730 | 13.910 | 19.190 | 12.420 |
| Absorptivity at 254 nm | L/gcm | 4.364 | 3.497 | 3.112 | 7.178 | 3.668 |
| Absorptivity at 275 nm | L/gcm | 3.454 | 3.209 | 2.883 | 6.146 | 3.159 |
| Absorptivity at 302 nm | L/gcm | 1.413 | 1.117 | 1.089 | 2.983 | 1.350 |
| Absorptivity at 310 nm | L/gcm | 1.001 | 0.824 | 0.844 | 2.528 | 1.104 |
| Absorptivity at 325 nm | L/gcm | 0.522 | 0.422 | 0.468 | 1.769 | 0.676 |
| Absorptivity at 339 nm | L/gcm | 0.305 | 0.255 | 0.295 | 1.273 | 0.441 |
| Absorptivity at 400 nm | L/gcm | 0.015 | 0.027 | 0.034 | 0.274 | 0.061 |
| Ratio of PNA's to Total, Ratio of adsorptivity at 302 nm to 226 nm | | 0.13 | 0.07 | 0.08 | 0.16 | 0.11 |

FIG. 10

HIGH VISCOSITY BASE STOCK COMPOSITIONS

CROSS-REFERENCE TO RELATED APPLICATIONS

This application claims priority to U.S. Provisional Application Ser. No. 62/254,753 filed Nov. 13, 2015, which is herein incorporated by reference in its entirety. This application is related to two other co-pending U.S. applications, filed on even date herewith, and identified by the following titles: Ser. No. 15/332,352 entitled "High Viscosity Base Stock Compositions" and Ser. No. 15/332,417 entitled "High Viscosity Base Stock Compositions". These co-pending U.S. applications are hereby incorporated by reference herein in their entirety.

FIELD

High viscosity lubricant base stock compositions, methods for making such base stock compositions, and lubricants incorporating such base stock compositions are provided.

BACKGROUND

Conventional methods for solvent processing to form Group I base stocks can produce various types of high viscosity base stocks, such as bright stocks. However, solvent processing is generally less effective at reducing the sulfur and/or nitrogen content of a feed, which can result in base stocks with detrimental amounts of heteroatom content. Hydrotreating and/or hydrocracking processes can be used prior to and/or after solvent processing for heteroatom removal, but such hydroprocessing can significantly reduce the viscosity of the resulting hydrotreated base stock.

More generally, high viscosity base stock capacity has declined as refiners have transitioned from solvent processing for lubricant base stock production to catalytic processing. While catalytic processing is suitable for making lower viscosity base stocks, the hydrotreating and hydrocracking processes used during catalytic processing tend to limit the ability to make base stocks with viscosities greater than about 10 cSt at 100° C.

Other options for high viscosity base stocks can include specialty polymeric materials, such as the poly-alpha-olefins in ExxonMobil SpectraSyn™ base stocks. Such polymeric base stocks can have bright stock type viscosities with reduced or minimized sulfur contents. However, production of such polymeric base stocks can be costly due to a need for specialized feeds to form the desired polymer.

U.S. Pat. No. 4,931,197 describes copolymers formed from α,β-unsaturated dicarboxylic acid esters and α-olefins. The copolymers are produced by copolymerization in the presence of a peroxide catalyst at temperatures of 80° C.-210° C. The copolymers are described as suitable for use as a lubricant for the shaping treatment of thermoplastic plastics.

U.S. Pat. No. 4,913,794 describes a process configuration for producing high viscosity lubricating oils. A lubricating oil and an organic peroxide are co-injected into a reactor to form a higher molecular weight product. The Examples provided in U.S. Pat. No. 4,913,794 describe processes using 10 wt % of an organic peroxide in the co-injected feed.

SUMMARY

In an aspect, a base stock composition is provided, the base stock composition having a number average molecular weight ($M_n$) of 600 g/mol to 3000 g/mol, a weight average molecular weight ($M_w$) of 900 g/mol to 10000 g/mol, a polydispersity ($M_w/M_n$) of at least 1.4, a pour point of 0° C. or less, a viscosity at 100° C. of at least 35 cSt, a viscosity at 40° C. of at least 600 cSt, and a viscosity index of at least 50.

In another aspect, a method of forming a base stock composition is provided, the method comprising introducing a feedstock having a viscosity index of 50 to 120, a viscosity at 100° C. of 12 cSt or less, and at least one of a sulfur content greater than 0.03 wt % and an aromatics content greater than 10 wt %, into a coupling reaction stage under effective coupling conditions to form a coupled effluent; and fractionating at least a portion of the coupled effluent to form at least a first product fraction having a viscosity index of at least 50, a polydispersity ($M_w/M_n$) of at least 1.4, a viscosity at 100° C. of at least 35 cSt, a viscosity at 40° C. of at least 600 cSt, and a pour point of 0° C. or less.

In another aspect, a method of forming a base stock composition is provided, the method comprising introducing a feedstock having a viscosity index of 50 to 120, a viscosity at 100° C. of 12 cSt or less, and at least one of a sulfur content greater than 0.03 wt % and an aromatics content greater than 10 wt %, into a coupling reaction stage under effective coupling conditions to form a coupled effluent; fractionating at least a portion of the coupled effluent to form at least a first coupled effluent fraction; and exposing at least a portion of the first coupled effluent fraction to a catalyst under effective catalytic processing conditions to form the first product fraction having a viscosity index of at least 50, a polydispersity ($M_w/M_n$) of at least 1.4, a viscosity at 100° C. of at least 35 cSt, a viscosity at 40° C. of at least 600 cSt, and a pour point of 0° C. or less.

BRIEF DESCRIPTION OF THE DRAWINGS

FIG. 9 shows characterization data for various base stock samples.

FIG. 10 shows UV absorptivity data for various base stock samples.

DETAILED DESCRIPTION

Figure 1:
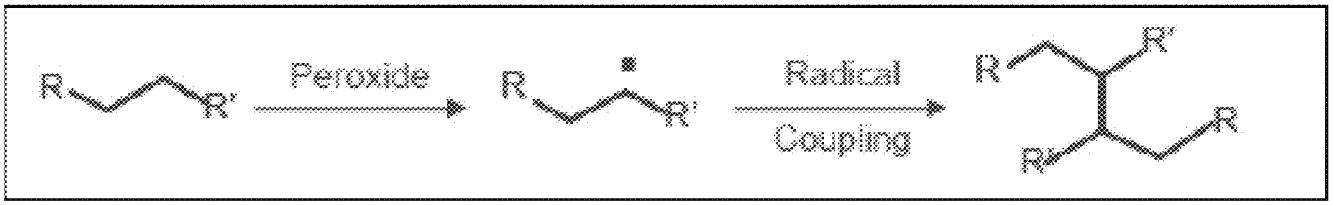
FIG. 1 schematically shows an example of a coupling reaction using a peroxide catalyst.

All numerical values within the detailed description and the claims herein are modified by "about" or "approximately" the indicated value, and take into account experimental error and variations that would be expected by a person having ordinary skill in the art.

Overview

In various aspects, methods are provided for producing Group I base stocks having high viscosity and also having one or more properties indicative of a high quality base stock. The resulting Group I base stocks can have a viscosity at 100° C. and/or a viscosity at 40° C. that is greater than the corresponding viscosity for a conventional Group I bright stock formed by solvent processing. Additionally, the resulting Group I base stocks can have one or more of the following properties that are indicative of a high quality base stock: a sulfur content of 0.5 wt % or less; a viscosity index of at least 100; a polydispersity of at least 1.4, or at least 1.7; a crystallization temperature of less than −20° C.; and/or other properties.

The high viscosity Group I base stock compositions described herein can be formed by coupling of compounds from a Group I base stock feed, or optionally a non-standard Group I base stock type feed. In this discussion, coupling of compounds is defined to include alkylation, oligomerization, and/or other reactions for combining and/or coupling molecules to increase molecular weight. It has been unexpectedly discovered that high molecular weight compositions having a desirable mix of properties can be formed by coupling components from a conventional base stock feed. The resulting compositions can have many of the benefits of a high molecular weight composition while also retaining many of the desirable properties of a conventional low molecular weight Group I base stock. Because the composition is formed from coupling of compounds from a lower viscosity conventional Group I base stock, the initial feed can be hydroprocessed to provide a desirable sulfur, nitrogen, and/or aromatics content prior to coupling to form the high viscosity bright stock. Although such hydroprocessing will typically reduce the viscosity of a base stock, the coupling of the base stock to form higher molecular weight compounds results in a substantially increased viscosity. As a result, any viscosity loss due to hydroprocessing is reduced, minimized, and/or mitigated.

According to API's classification, Group I base stocks are defined as base stocks with less than 90 wt % saturated molecules and/or at least 0.03 wt % sulfur content. Group I base stocks also have a viscosity index (VI) of at least 80 but less than 120. Group II base stocks contain at least 90 wt % saturated molecules and less than 0.03 wt % sulfur. Group II base stocks also have a viscosity index of at least 80 but less than 120. Group III base stocks contain at least 90 wt % saturated molecules and less than 0.03 wt % sulfur, with a viscosity index of at least 120.

In this discussion, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst.

One way of defining a feedstock is based on the boiling range of the feed. One option for defining a boiling range is to use an initial boiling point for a feed and/or a final boiling point for a feed. Another option, which in some instances may provide a more representative description of a feed, is to characterize a feed based on the amount of the feed that boils at one or more temperatures. For example, a "T5" boiling point or distillation point for a feed is defined as the temperature at which 5 wt % of the feed is distilled or boiled off. Similarly, a "T95" boiling point is a temperature at which 95 wt % of the feed is distilled or boiled off.

In this discussion, unless otherwise specified the lubricant product fraction of a catalytically and/or solvent processed feedstock corresponds to the fraction having an initial boiling point and/or a T5 distillation point of at least about 370° C. (700° F.). A distillate fuel product fraction, such as a diesel product fraction, corresponds to a product fraction having a boiling range from about 177° C. (350° F.) to about 370° C. (700° F.). Thus, distillate fuel product fractions have initial boiling points (or alternatively T5 boiling points) of at least about 193° C. and final boiling points (or alternatively T95 boiling points) of about 370° C. or less. A naphtha fuel product fraction corresponds to a product fraction having a boiling range from about 35° C. (95° F.) to about 177° C. (350° F.). Thus, naphtha fuel product fractions have initial boiling points (or alternatively T5 boiling points) of at least about 35° C. and final boiling points (or alternatively T95 boiling points) of about 177° C. or less. It is noted that 35° C. roughly corresponds to a boiling point for the various isomers of a C5 alkane. When determining a boiling point or a boiling range for a feed or product fraction, an appropriate ASTM test method can be used, such as the procedures described in ASTM D2887 or D86.

Feedstock for Forming High Viscosity Base Stock—Group I Base Stock

The base stock compositions described herein can be formed from a variety of feedstocks. A convenient type of feed can be a Group I base stock formed by conventional solvent processing. Optionally, such a feed can be hydroprocessed to achieve a desired sulfur content, nitrogen content, and/or aromatics content. In some aspects, the feed can correspond to a "viscosity index expanded" Group I base stock. An "viscosity index expanded" Group I base stock is defined herein as a feed that has properties similar to a Group I base stock, but where the viscosity index for the feed is below the typical range for a Group I base stock. A viscosity index expanded Group I base stock as defined herein can have a viscosity index of at least 50.

A suitable Group I base stock (and/or expanded viscosity index Group I base stock) for forming a high viscosity base stock as described herein can be characterized in a variety of ways. For example, a suitable Group I base stock for use as a feed for forming a high viscosity base stock can have a viscosity at 100° C. of cSt2 cSt to 50 cSt, or 2 cSt to 40 cSt, or 2 cSt to 30 cSt, or 2 cSt to 20 cSt, or 2 cSt to 16 cSt, or 2 cSt to 12 cSt, or 2 cSt to 10 cSt, or 2 cSt to 8 cSt, or 4 cSt to 50 cSt, or 4 cSt to 40 cSt, or 4 cSt to 30 cSt, or 4 cSt to 20 cSt, or 4 cSt to 16 cSt, or 4 cSt to 12 cSt, or 4 cSt to 10 cSt, or 4 cSt to 8 cSt, or 6 cSt to 50 cSt, or 6 cSt to 40 cSt, or 6 cSt to 30 cSt, or 6 cSt to 20 cSt, or 6 cSt to 16 cSt, or 6 cSt to 12 cSt, or 6 cSt to 10 cSt, or 8 cSt to 50 cSt, or 8 cSt to 40 cSt, or 8 cSt to 30 cSt, or 8 cSt to 20 cSt, or 8 cSt to 16 cSt, or 8 cSt to 12 cSt, or 10 cSt to 50 cSt, or 10 cSt to 40 cSt, or 10 cSt to 30 cSt, or 10 cSt to 20 cSt, or 10 cSt to 16 cSt, or 12 cSt to 50 cSt, or 12 cSt to 40 cSt, or 12 cSt to 30 cSt, or 12 cSt to 20 cSt.

Additionally or alternately, the feedstock can have a viscosity index of 50 to 120, or 60 to 120, or 70 to 120, or 80 to 120, or 90 to 120, or 100 to 120, or 50 to 110, or 60 to 110, or 70 to 110, or 80 to 110, or 90 to 110, or 50 to 100, or 60 to 100, or 70 to 100, or 80 to 100, or 50 to 90, or 60 to 90, or 70 to 90, or 50 to 80, or 60 to 80. It is noted that some of the above listed viscosity index ranges include viscosity index values that are outside (below) the definition for a Group I base stock, and therefore at least partially correspond to expanded viscosity index Group I base stocks. In some aspects, at least 50 wt % of the feedstock, or at least 60 wt %, or at least 70 wt %, or at least 80 wt %, or at least 90 wt %, or substantially all of the feedstock (at least 95 wt %) can correspond to a Group I base stock having a viscosity index within the conventional range of viscosity index values for a Group I base stock, such as at least 80 and/or 120 or less. Optionally, the feedstock can include some Group II base stock and/or Group III base stock, such as at least 1 wt %, or at least 5 wt %, or at least 10 wt %, or at least 20 wt %, or at least 30 wt %, and/or less than 50 wt %, or 40 wt % or less, or 30 wt % or less, or 20 wt % or less, or 10 wt % or less. Each of the above lower bounds for an amount of Group II and/or Group III basestock in the feedstock is explicitly contemplated in conjunction with each of the above lower bounds.

Additionally or alternately, the feedstock can have a density at 15.6° C. of 0.92 g/cm3 or less, or 0.91 g/cm3 or less, or 0.90 g/cm3 or less, or 0.89 g/cm3, such as down to about 0.85 g/cm3 or lower.

Additionally or alternately, the molecular weight of the feedstock can be characterized based on number average molecular weight (corresponding to the typical average weight calculation), and/or based on mass or weight average molecular weight, where the sum of the squares of the molecular weights is divided by the sum of the molecular weights, and/or based on polydispersity, which is the weight average molecular weight divided by the number average molecular weight.

The number average molecular weight Mn of a feed can be mathematically expressed as $$M_n = \frac{\sum_i N_i M_i}{\sum_i N_i} \tag{1}$$

In Equation (1), Ni is the number of molecules having a molecular weight Mi. The weight average molecular weight, Mw, gives a larger weighting to heavier molecules. The weight average molecular weight can be mathematically expressed as $$M_w = \frac{\sum_i N_i M_i^2}{\sum_i N_i M_i} \tag{2}$$

The polydispersity can then be expressed as Mw/Mn. In various aspects, the feedstock can have a polydispersity of 1.30 or less, or 1.25 or less, or 1.20 or less, and/or at least about 1.0. Additionally or alternately, the feedstock can have a number average molecular weight (Mn) of 400 to 1200 g/mol. Additionally or alternately, the feedstock can have a weight average molecular weight (Mw) of 800 to 1400 g/mol.

As an example of a processing for forming a conventional Group I base stock, a feedstock for lubricant base oil production can be processed either using solvent dewaxing or using catalytic dewaxing. For example, in a lube solvent plant, a vacuum gas oil (VGO) or another suitable feed is fractionated into light neutral (LN) and heavy neutral (HN) distillates and a bottom fraction by some type of vacuum distillation. The bottoms fraction is subsequently deasphalted to recover an asphalt fraction and a brightstock. The LN distillate, HN distillate, and brightstock are then solvent extracted to remove the most polar molecules as an extract and corresponding LN distillate, HN distillate, and brightstock raffinates. The raffinates are then solvent dewaxed to obtain a LN distillate, HN distillate, and brightstock basestocks with acceptable low temperature properties. It is beneficial to hydrofinish the lubricant basestocks either before or after the solvent dewaxing step. The resulting lubricant basestocks may contain a significant amount of aromatics (up to 25%) and high sulfur (>300 ppm). Thus, the typical base oils formed from solvent dewaxing alone are Group I basestocks. As an alternative, a raffinate hydroconversion step can be performed prior to the solvent dewaxing. The hydroconversion is essentially a treatment under high H2 pressure in presence of a metal sulfide based hydroprocessing catalyst which remove most of the sulfur and nitrogen. The amount of conversion in the hydroconversion reaction is typically tuned to obtain a predetermined increase in viscosity index and 95%+ saturates. This allows the solvent dewaxed lubricant basestock products to be used as Group II or Group II+ basestocks. Optionally, the wax recovered from a solvent dewaxing unit may also be processed by catalytic dewaxing to produce Group III or Group III+ lubricant basestocks.

A wide range of petroleum and chemical feedstocks can be distilled, solvent processed, and/or hydroprocessed in order to form a suitable Group I base stock for use as a starting material for forming a high viscosity base stock. Suitable feedstocks for solvent processing include whole and reduced petroleum crudes, atmospheric residua, propane deasphalted residua, cycle oils, gas oils, including vacuum gas oils and coker gas oils, light to heavy distillates including raw virgin distillates, hydrocrackates, hydrotreated oils, slack waxes, Fischer-Tropsch waxes, raffinates, and mixtures of these materials. Optionally, feeds derived from a biological source that have an appropriate boiling range can also form at least a portion of the feedstock.

Typical feeds include, for example, feeds with an initial boiling point of at least about 650° F. (343° C.), or at least about 700° F. (371° C.), or at least about 750° F. (399° C.). Alternatively, a feed may be characterized using a T5 boiling point, such as a feed with a T5 boiling point of at least about 650° F. (343° C.), or at least about 700° F. (371° C.), or at least about 750° F. (399° C.). In some aspects, the final boiling point of the feed can be at least about 1100° F. (593° C.), such as at least about 1150° F. (621° C.) or at least about 1200° F. (649° C.). In other aspects, a feed may be used that does not include a large portion of molecules that would traditional be considered as vacuum distillation bottoms. For example, the feed may correspond to a vacuum gas oil feed that has already been separated from a traditional vacuum bottoms portion. Such feeds include, for example, feeds with a final boiling point of about 1100° F. (593° C.), or about 1000° F. (538° C.) or less, or about 900° F. (482° C.) or less. Alternatively, a feed may be characterized using a T95 boiling point, such as a feed with a T95 boiling point of about 1100° F. (593° C.) or less, or about 1000° F. (538° C.) or less, or about 900° F. (482° C.) or less. An example of a suitable type of feedstock is a wide cut vacuum gas oil (VGO) feed, with a T5 boiling point of at least about 700° F. (371° C.) and a T95 boiling point of about 1100° F. or less. Optionally, the initial boiling point of such a wide cut VGO feed can be at least about 700° F. and/or the final boiling point can be at least about 1100° F. It is noted that feeds with still lower initial boiling points and/or T5 boiling points may also be suitable, so long as sufficient higher boiling material is available so that the overall nature of the process is suitable for production of lubricant base stocks.

The above feed description corresponds to a potential feed for producing lubricant base stocks. In some aspects, lubricant base stocks can be produced as part of a process for producing both fuels and lubricants. Because fuels are a desired product in such processes, feedstocks with lower boiling components may also be suitable. For example, a feedstock suitable for fuels production, such as a light cycle oil, can have a T5 boiling point of at least about 350° F. (177° C.), such as at least about 400° F. (204° C.). Examples of a suitable boiling range include a boiling range of from about 350° F. (177° C.) to about 700° F. (371° C.), such as from about 390° F. (200° C.) to about 650° F. (343° C.). Thus, a portion of the feed used for fuels and lubricant base stock production can include components having a boiling range from about 170° C. to about 350° C. Such components can be part of an initial feed, or a first feed with a T5 boiling point of about 650° F. (343° C.) can be combined with a second feed, such as a light cycle oil, that includes components that boil between 200° C. and 350° C.

An initial feed for lubricant base stock production (or for production of both fuels and lubricant base stocks) can be distilled to form various fractions. For conventional Group I lubricant production, suitable fractions can include vacuum gas oil fractions, deasphalted oil fractions, and combinations thereof.

One fraction formed during vacuum distillation of a feedstock is a vacuum gas oil fraction, which corresponds to a distillate fraction having a boiling range (as described above) from at least about 650° F. (343° C.) or at least about 700° F. (371° C.) to about 1100° F. (593° C.) or less, or about 1000° F. (538° C.) or less, or about 900° F. (482° C.) or less. A vacuum gas oil fraction can be suitable for solvent processing to form a Group I base stock. Optionally, a narrower vacuum gas oil cut may be used, such as a narrower cut having an initial boiling point and/or T5 boiling point of at least about 750° F. (399° C.), or at least about 800° F. (427° C.), or at least about 850° F. (454° C.).

Another fraction formed during vacuum distillation of the feedstock is a bottoms portion. This bottoms portion can include a variety of types of molecules, including asphaltenes. Solvent deasphalting can be used to separate asphaltenes from the remainder of the bottoms portion. This results in an asphalt or asphaltene fraction and a deasphalted bottoms fraction, which may be suitable for use in production of Group I base stocks.

Solvent deasphalting is a solvent extraction process. Typical solvents include alkanes or other hydrocarbons containing about 3 to about 6 carbons per molecule. Examples of suitable solvents include propane, n-butane, isobutene, and n-pentane. Alternatively, other types of solvents may also be suitable, such as supercritical fluids. During solvent deasphalting, a feed portion is mixed with the solvent. Portions of the feed that are soluble in the solvent are then extracted, leaving behind a residue with little or no solubility in the solvent. Typical solvent deasphalting conditions include mixing a feedstock fraction with a solvent in a weight ratio of from about 1:2 to about 1:10, such as about 1:8 or less. Typical solvent deasphalting temperatures range from about 40° C. to about 150° C. The pressure during solvent deasphalting can be from about 50 psig (345 kPag) to about 500 psig (3447 kPag).

The portion of the deasphalted feedstock that is extracted with the solvent is often referred to as deasphalted oil. In various aspects, the bottoms from vacuum distillation can be used as the feed to the solvent deasphalter, so the portion extracted with the solvent can also be referred to as deasphalted bottoms. The yield of deasphalted oil from a solvent deasphalting process varies depending on a variety of factors, including the nature of the feedstock, the type of solvent, and the solvent extraction conditions. A lighter molecular weight solvent such as propane will result in a lower yield of deasphalted oil as compared to n-pentane, as fewer components of a bottoms fraction will be soluble in the shorter chain alkane. However, the deasphalted oil resulting from propane deasphalting is typically of higher quality, resulting in expanded options for use of the deasphalted oil. Under typical deasphalting conditions, increasing the temperature will also usually reduce the yield while increasing the quality of the resulting deasphalted oil. In various embodiments, the yield of deasphalted oil from solvent deasphalting can be about 85 wt % or less of the feed to the deasphalting process, or about 75 wt % or less. Preferably, the solvent deasphalting conditions are selected so that the yield of deasphalted oil is at least about 65 wt %, such as at least about 70 wt % or at least about 75 wt %. The deasphalted bottoms resulting from the solvent deasphalting procedure are then combined with the higher boiling portion from the vacuum distillation unit for solvent processing.

After a deasphalting process, the yield of deasphalting residue is typically at least about 15 wt % of the feed to the deasphalting process, but is preferably about 35 wt % or less, such as about 30 wt % or less or 25 wt % or less. The deasphalting residue can be used, for example, for making various grades of asphalt.

Two types of solvent processing can be performed on vacuum gas oil and/or deasphalted bottoms as part of production of a Group I base stock. The first type of solvent processing is a solvent extraction to reduce the aromatics content and/or the amount of polar molecules. The solvent extraction process selectively dissolves aromatic components to form an aromatics-rich extract phase while leaving the more paraffinic components in an aromatics-poor raffinate phase. Naphthenes are distributed between the extract and raffinate phases. Typical solvents for solvent extraction include phenol, furfural and N-methyl pyrrolidone. By controlling the solvent to oil ratio, extraction temperature and method of contacting distillate to be extracted with solvent, one can control the degree of separation between the extract and raffinate phases. Any convenient type of liquid-liquid extractor can be used, such as a counter-current liquid-liquid extractor. Depending on the initial concentration of aromatics in the deasphalted bottoms, the raffinate phase can have an aromatics content of about 5 wt % to about 25 wt %. For typical feeds, the aromatics contents will be at least about 10 wt %.

In some aspects, a deasphalted bottoms fraction and a vacuum gas oil fraction can be solvent processed together. Alternatively, different fractions can be solvent processed separately, to facilitate formation of different types of lubricant base oils. For example, a vacuum gas oil fraction can be solvent extracted and then solvent dewaxed to form a Group I base oil of lower viscosity while a deasphalted bottoms fraction can be solvent processed to form a conventional brightstock. Of course, multiple vacuum gas oil fractions and/or deasphalted oil fractions could be solvent processed separately if more than one distinct Group I base oil and/or brightstock is desired.

The raffinate from the solvent extraction is optionally but preferably under-extracted. In such optional aspects, the extraction is carried out under conditions such that the raffinate yield is increased or maximized while still removing most of the lowest quality molecules from the feed. Raffinate yield may be increased or maximized by controlling extraction conditions, for example, by lowering the solvent to oil treat ratio and/or decreasing the extraction temperature. The raffinate from the solvent extraction unit can then be solvent dewaxed under solvent dewaxing conditions to remove hard waxes from the raffinate.

Solvent dewaxing typically involves mixing the raffinate feed from the solvent extraction unit with chilled dewaxing solvent to form an oil-solvent solution. Precipitated wax is thereafter separated by, for example, filtration. The temperature and solvent are selected so that the oil is dissolved by the chilled solvent while the wax is precipitated.

An example of a suitable solvent dewaxing process involves the use of a cooling tower where solvent is prechilled and added incrementally at several points along the height of the cooling tower. The oil-solvent mixture is agitated during the chilling step to permit substantially instantaneous mixing of the prechilled solvent with the oil. The prechilled solvent is added incrementally along the length of the cooling tower so as to maintain an average chilling rate at or below 10° F. per minute, usually between about 1 to about 5° F. per minute. The final temperature of the oil-solvent/precipitated wax mixture in the cooling tower will usually be between 0 and 50° F. (−17.8 to 10° C.). The mixture may then be sent to a scraped surface chiller to separate precipitated wax from the mixture.

Representative dewaxing solvents are aliphatic ketones having 3-6 carbon atoms such as methyl ethyl ketone and methyl isobutyl ketone, low molecular weight hydrocarbons such as propane and butane, and mixtures thereof. The solvents may be mixed with other solvents such as benzene, toluene or xylene.

In general, the amount of solvent added will be sufficient to provide a liquid/solid weight ratio between the range of 5/1 and 20/1 at the dewaxing temperature and a solvent/oil volume ratio between 1.5/1 to 5/1. The solvent dewaxed oil is typically dewaxed to an intermediate pour point, preferably less than about +10° C., such as less than about 5° C. or less than about 0° C. The resulting solvent dewaxed base stock can be suitable for use in forming one or more types of Group I base oils. The aromatics content will typically be greater than 10 wt % in the solvent dewaxed oil. Additionally, the sulfur content of the solvent dewaxed oil will typically be greater than 300 wppm.

Either prior to or after any of the above solvent processing steps, the feedstock can also be hydrotreated or otherwise hydroprocessed to reduce the sulfur content of the base stock. Some feeds for conventional Group I base stock production can have an initial sulfur content at least 1000 wppm of sulfur, or at least 2000 wppm, or at least 4000 wppm, or at least 10,000 wppm, or at least about 20,000 wppm. Hydroprocessing can be used to reduce the sulfur content of the resulting conventional Group I base stock to about 1000 wppm or less, or about 500 wppm or less, or about 100 wppm or less. Optionally but preferably, the hydroprocessing can also retain at least about 10 wt % aromatics in the resulting hydroprocessed base stock, or at least about 15 wt %, or at least about 20 wt %, or at least about 25 wt %, or at least about 30 wt %, such as up to about 50 wt % or up to about 70 wt %.

Group I base stocks can also be formed by catalytic dewaxing of the raffinate from a solvent extraction unit. Suitable dewaxing catalysts can include molecular sieves such as crystalline aluminosilicates (zeolites). Examples of suitable dewaxing catalysts can include, but are not limited to, ZSM-5, ZSM-11, ZSM-22, ZSM-23, ZSM-35, ZSM-48, zeolite Beta, or a combination thereof. Catalysts based on ZSM-5 are preferred for the production of Group I base stocks. In various embodiments, the dewaxing catalysts can optionally further include a metal hydrogenation component. The metal hydrogenation component is typically a Group VI and/or a Group VIII metal. Preferably the metal hydrogenation component can be a combination of a non-noble Group VIII metal with a Group VI metal. Suitable combinations can include Ni, Co, or Fe with Mo or W, preferably Ni with Mo or W.

For embodiments where the metal is a combination of a non-noble Group VIII metal with a Group VI metal, the combined amount of metal can be from 0.5 wt % to 40 wt %, or 2 wt % to 35 wt %, or 5 wt % to 30 wt %.

The dewaxing catalysts useful in processes according to the disclosure can also include a binder. The amount of zeolite in a catalyst formulated using a binder can be from about 30 wt % zeolite to 90 wt % zeolite relative to the combined weight of binder and zeolite. Preferably, the amount of zeolite is at least about 50 wt % of the combined weight of zeolite and binder, such as at least about 60 wt % or from about 65 wt % to about 80 wt %.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture.

Effective dewaxing conditions can include a temperature of at least about 500° F. (260° C.), or at least about 550° F. (288° C.), or at least about 600° F. (316° C.), or at least about 650° F. (343° C.). Alternatively, the temperature can be about 800° F. (427° C.) or less, or 750° F. (399° C.) or less, or about 700° F. (371° C.) or less, or about 650° F. (343° C.) or less. For example, the dewaxing temperature can be about 600° F. (316° C.) to about 750° F. (399° C.), or about 650° F. (343° C.) to about 750° F. (399° C.), or about 650° F. (343° C.) to about 725° F. (385° C.), or about 650° F. (343° C.) to about 700° F. (371° C.), or about 675° F. (357° C.) to about 750° F. (399° C.), or about 700° F. (371° C.) to about 750° F. (399° C.). The pressure can be at least about 250 psig (1.8 MPa), or at least about 500 psig (3.4 MPa), or at least about 750 psig (5.2 MPa), or at least about 1000 psig (6.9 MPa). Alternatively, the pressure can be about 5000 psig (34.6 MPa) or less, or about 3000 psig (20.7 MPa) or less, or about 1500 psig (10.3 MPa) or less, or about 1200 psig (8.2 MPa) or less, or about 1000 psig (6.9 MPa) or less, or about 800 psig (5.5 MPa) or less. The Liquid Hourly Space Velocity (LHSV) can be at least about 0.5 $hr^{-1}$, or at least about 1.0 $hr^{-1}$, or at least about 1.5 $hr^{-1}$. Alternatively, the LHSV can be about 10.0 $hr^{-1}$ or less, or about 5.0 $hr^{-1}$ or less, or about 3.0 $hr^{-1}$ or less, or about 2.0 $hr^{-1}$ or less. The treat gas rate can be at least about 500 scf/bbl (89 $Nm^3/m^3$), at least about 750 scf/bbl (134 $Nm^3/m^3$), or at least about 1000 scf/bbl (178 $Nm^3/m^3$). Alternatively, the treat gas rate can be about 10000 scf/bbl (1781 $Nm^3/m^3$) or less, or about 6000 scf/bbl (1069 $Nm^3/m^3$) or less, or about 4000 scf/bbl (712 $Nm^3/m^3$) or less, or about 2000 scf/bbl (356 $Nm^3/m^3$) or less, or about 1500 scf/bbl (267 $Nm^3/m^3$) or less.

Reactions to Form High Viscosity Base Stocks

There are various chemistry options that can be used for increasing the molecular weight of components found in Group I base stocks (optionally including expanded viscosity index Group I base stocks). Examples of suitable reactions can include, but are not limited to, reactions such as olefin oligomerization, Friedel-Craft aromatic alkylation, radical coupling via peroxide, or catalyzed coupling using sulfur. In general, higher temperature reaction conditions can provide an increased reaction rate, while longer reaction times can improve the yield of coupled reaction product.

FIG. 1 shows an example of the general scheme for coupling compounds via radical coupling using a peroxide catalyst. The reaction shown in FIG. 1 is provided as an example, and is not intended to indicate a particular reaction location or product. As shown in FIG. 1, a compound is exposed to the presence of a peroxide, which results in formation of a radical. The radical compound has an increased reactivity which can facilitate coupling with another compound. It is noted that although the peroxide may be referred to as a catalyst herein, the peroxide is converted during the reaction from peroxide to two alcohols.

Figure 2:
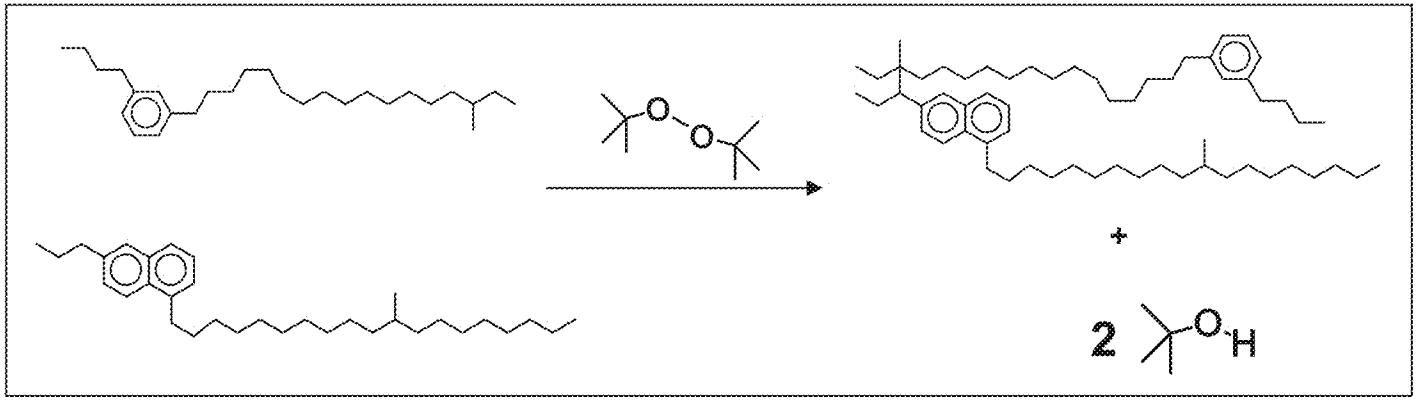
FIG. 2 schematically shows an example of a coupling reaction using a peroxide catalyst.

A similar schematic example of a radical coupling reaction with lubricant boiling range molecules is shown in FIG. 2. The reaction shown in FIG. 1 is provided as an example, and is not intended to indicate a particular reaction location or product. As shown in the example reaction in FIG. 2, radical coupling using peroxide can be used to couple two lubricant boiling range molecules together to form a larger compound. It has been discovered that converting a portion of a lubricant boiling range feed, such as a Group I lubricant base stock, to higher molecular weight compounds can produce a high viscosity lubricant base stock.

In the reaction scheme shown in FIG. 2, a dialkyl peroxide is used as the source of peroxide. Any convenient dialkyl peroxide can be used. Optionally, the alkyl groups in the peroxide can each include at least 3 carbons, or at least 4 carbons, or at least 5 carbons. In some aspects, the peroxide can be bonded to one or both of the alkyl groups at a tertiary carbon. For example, one or both of the alkyl groups can be a t-butyl (tertiary butyl) group. To facilitate the coupling reaction, a feedstock can be mixed with 5 wt % to 80 wt % (relative to a weight of the feedstock) of dialkyl peroxide(s), or 5 wt % to 70 wt %, or 5 wt % to 60 wt %, or 5 wt % to 50 wt %, or 5 wt % to 40 wt %, or 5 wt % to 30 wt %, or 5 wt % to 20 wt %, or 10 wt % to 80 wt %, or 10 wt % to 70 wt %, or 10 wt % to 60 wt %, or 10 wt % to 50 wt %, or 10 wt % to 40 wt %, or 10 wt % to 30 wt %, or 10 wt % to 20 wt %, or 15 wt % to 80 wt %, or 15 wt % to 70 wt %, or 15 wt % to 60 wt %, or 15 wt % to 50 wt %, or 15 wt % to 40 wt %, or 15 wt % to 30 wt %, or 20 wt % to 80 wt %, or 20 wt % to 70 wt %, or 20 wt % to 60 wt %, or 20 wt % to 50 wt %, or 20 wt % to 40 wt %, or 20 wt % to 30 wt %, or 25 wt % to 80 wt %, or 25 wt % to 70 wt %, or 25 wt % to 60 wt %, or 25 wt % to 50 wt %, or 25 wt % to 40 wt %, or 30 wt % to 80 wt %, or 30 wt % to 70 wt %, or 30 wt % to 60 wt %, or 30 wt % to 50 wt %, or 30 wt % to 40 wt %. The feedstock can be exposed to the dialkyl peroxide for a convenient period of time, such as about 10 minutes to about 10 hours. The temperature during exposure of the feedstock to the dialkyl peroxide can be from about 50° C. to about 300° C., preferably from about 120° C. to about 260° C., optionally at least about 140° C. and/or optionally about 230° C. or less. It is noted that while the above time and temperature conditions refer to batch operation, one of skill in the art can readily adapt this reaction as a continuous flow reaction scheme by selecting appropriate flow rates/residence times/temperatures. The reactor configuration and temperatures/space velocities described in U.S. Pat. No. 4,913,794 provide another example of conditions that can be used for formation of high viscosity, high quality base stocks, which is incorporated herein by reference with respect to the reactor configuration, temperatures, and space velocities.

Figure 3:
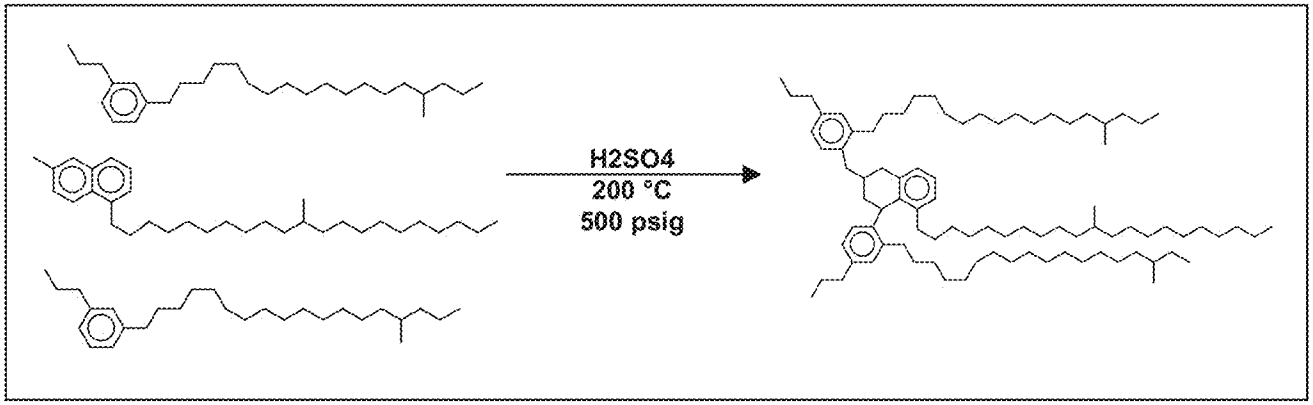
FIG. 3 schematically shows an example of a coupling reaction in an acidic reaction environment.
Figure 4:
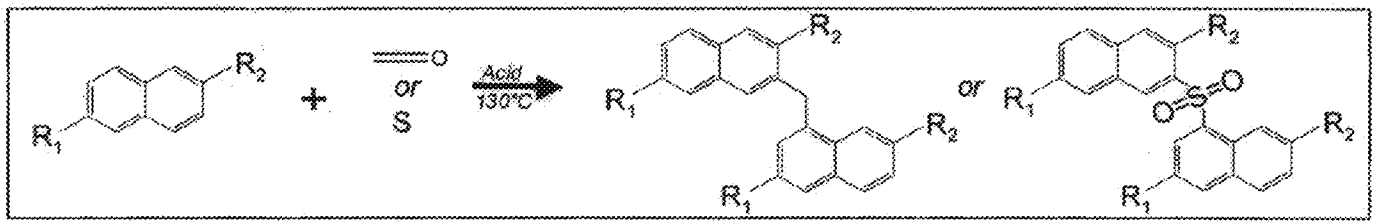
FIG. 4 schematically shows an example of a coupling reaction in an acidic reaction environment.
Figure 5:
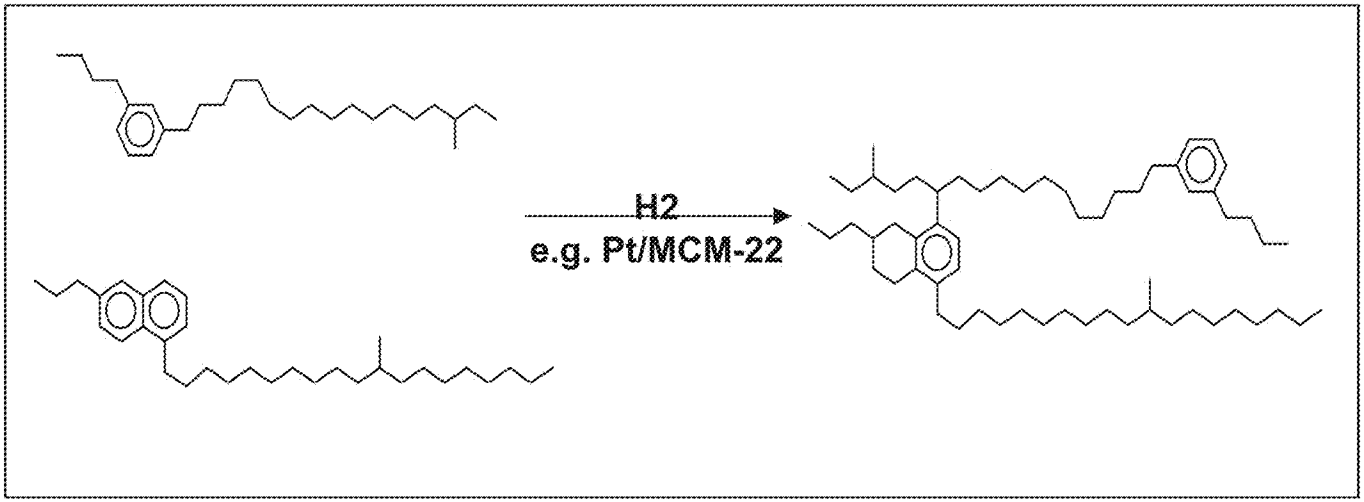
FIG. 5 schematically shows an example of a coupling reaction in the presence of a solid acid catalyst.

FIGS. 3 to 5 show schematic examples of other types of reaction schemes, including examples of aromatic coupling with sulfuric acid (FIG. 3), aromatic coupling with oxalic acid, formaldehyde, or sulfur (FIG. 4), and aromatic alkylation in the presence of a molecular sieve catalyst with a supported (noble) metal (FIG. 5). All of the reactions shown in FIGS. 3-5 are intended as examples, as these reaction mechanisms are generally known to those of skill in the art. Coupling using sulfuric acid as shown in FIG. 3 can generally be performed at temperatures between 150° C. and 250° C. and at pressures between about 100 psig (0.7 MPag) and 1000 psig (7 MPag). Coupling using sulfur or an organic compound containing a carbonyl group as shown in FIG. 4 can generally be performed at temperatures between 100° C. and 200° C. and/or at temperatures suitable for general Friedel-Craft alkylation. An additional acid can also be introduced into the reaction environment to catalyze the reaction. Suitable acids can include, for example, conventional catalysts suitable for Friedel-Craft alkylation. Aromatic alkylation in the presence of a molecular sieve with a supported metal is also a conventionally known process. FIG. 5 shows an example of aromatic alkylation performed in the presence of a Pt on MCM-22 catalyst, but any convenient conventional aromatic alkylation catalyst can be used.

Figure 6:
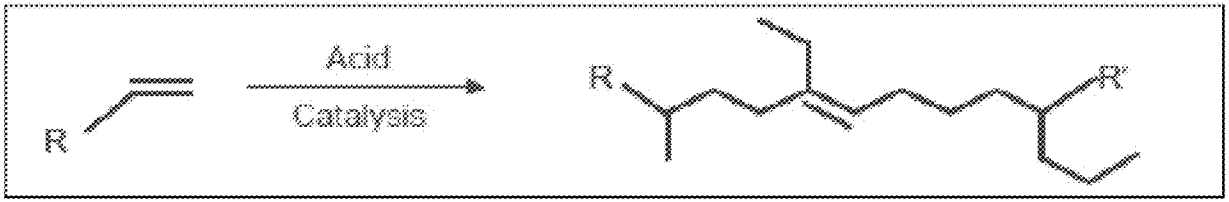
FIG. 6 schematically shows an example of a coupling reaction based on olefin oligomerization.

It is noted that all of the reaction mechanisms shown in FIGS. 1-5 involve elevated temperature and the presence of a peroxide catalyst, an acidic catalyst, and/or an acidic reaction environment. An additional reaction that can also occur under conditions similar to those shown in FIGS. 1-5 is olefin oligomerization, where two olefin-containing compounds within a feed are coupled to form a single larger olefin-containing compound. An example of an olefin oligomerization reaction is shown in FIG. 6. Optionally, if a feed suitable for Group I base stock formation and/or a Group I base stock had a sufficient amount of olefin-containing compounds, olefin oligomerization could be used as the primary coupling reaction mechanism for forming a high viscosity base stock.

The product formed after exposing a Group I base stock to a coupling reaction can correspond to a high viscosity base stock with desirable properties, or optionally additional hydroprocessing can be used to improve the properties of the high viscosity base stock. As an example, in aspects where the coupling reaction is based on a peroxide catalyst, the coupling reaction may introduce additional oxygen heteroatoms into the reaction product. Prior to hydroprocessing, the properties of the high viscosity base stock product may be less favorable due to the presence of the oxygen heteroatoms. Hydroprocessing of the high viscosity base stock can remove the oxygen heteroatoms, leading to improved properties.

Figure 7:
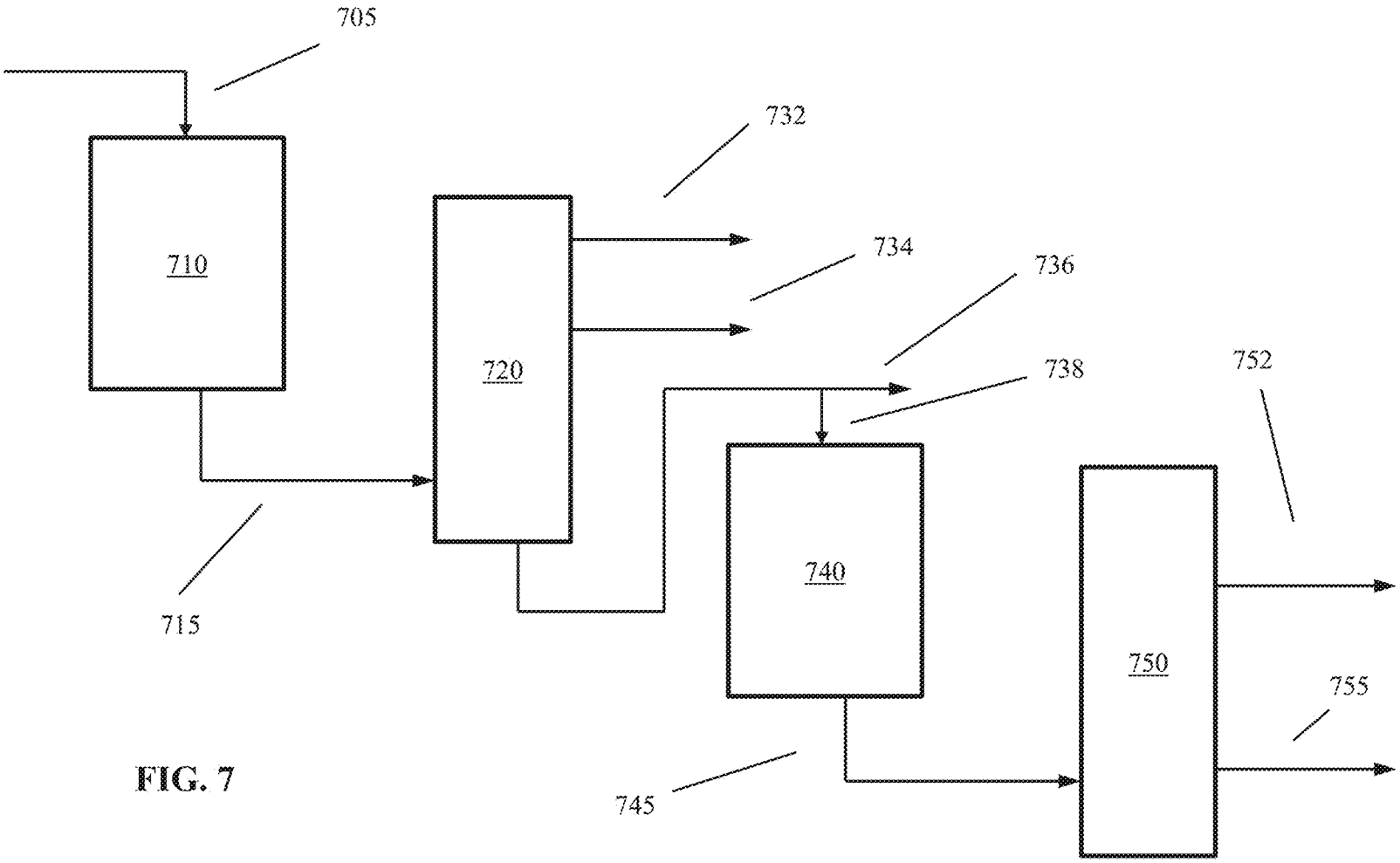
FIG. 7 schematically shows an example of a reaction system suitable for making a high viscosity composition as described herein.

FIG. 7 shows an example of a reaction system suitable for production of high viscosity base stocks as described herein. In FIG. 7, an initial feed 705 of Group I base stock (or expanded viscosity index Group I base stock) is passed into a coupling reaction stage 710, such as a reaction stage for coupling in the presence of a peroxide catalyst. The effluent 715 from the coupling stage is passed into a fractionator 720, such as a vacuum distillation column. The fractionator 720 can allow for separation of the coupling effluent 715 into a plurality of products, such as one or more light neutral products 732, one or more heavy neutral products 734, and a brightstock product 736. Optionally, a portion of the brightstock product 736 can be used without further treatment. The remaining portion 738 of the brightstock product can then be catalytically processed 740. Catalytic processing 740 can include one or more of hydrotreatment, catalytic dewaxing, and/or hydrofinishing. The catalytically processed effluent 745 can then be separated 750 to form at least a fuels boiling range product 752 and a high viscosity base stock product 755. The fuels boiling range product can have a T95 boiling point of about 750° F. (399° C.) or less, or about 700° F. (371° C.) or less, or about 650° F. (343° C.) or less. Optionally, a plurality of fuels boiling range products 752 can be formed, with the additional fuels boiling range products corresponding to naphtha boiling range products, kerosene boiling range products, and/or additional lower boiling range diesel products.

It is noted that some feeds can allow for production of high viscosity base stocks as described herein without passing the coupled effluent through a catalytic processing stage 740. For example, a feed comprising a raffinate hydroconversion effluent can have a sufficiently low aromatics content to potentially avoid the need for catalytic treatment of the coupled effluent.

Catalytic Processing Conditions

After the coupling reaction, the high viscosity base stocks described herein can be optionally but preferably catalytically processed to improve the properties of the base stock. The optional catalytic processing can include one or more of hydrotreatment, catalytic dewaxing, and/or hydrofinishing. In aspects where more than one type of catalytic processing is performed, the effluent from a first type of catalytic processing can optionally be separated prior to the second type of catalytic processing. For example, after a hydrotreatment or hydrofinishing process, a gas-liquid separation can be performed to remove light ends, $H_2S$, and/or $NH_3$ that may have formed.

Hydrotreatment is typically used to reduce the sulfur, nitrogen, and aromatic content of a feed. The catalysts used for hydrotreatment of the heavy portion of the crude oil from the flash separator can include conventional hydroprocessing catalysts, such as those that comprise at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. More generally, any convenient size, shape, and/or pore size distribution for a catalyst suitable for hydrotreatment of a distillate (including lubricant base oil) boiling range feed in a conventional manner may be used. It is within the scope of the present disclosure that more than one type of hydroprocessing catalyst can be used in one or multiple reaction vessels.

The at least one Group VIII non-noble metal, in oxide form, can typically be present in an amount ranging from about 2 wt % to about 40 wt %, preferably from about 4 wt % to about 15 wt %. The at least one Group VI metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this disclosure, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage will preferably contain at least about 50 vol. % and more preferably at least about 75 vol. % hydrogen.

Hydrogen can be supplied at a rate of from about 100 SCF/B (standard cubic feet of hydrogen per barrel of feed) (17 $Nm^3/m^3$) to about 1500 SCF/B (253 $Nm^3/m^3$). Preferably, the hydrogen is provided in a range of from about 200 SCF/B (34 $Nm^3/m^3$) to about 1200 SCF/B (202 $Nm^3/m^3$). Hydrogen can be supplied co-currently with the input feed to the hydrotreatment reactor and/or reaction zone or separately via a separate gas conduit to the hydrotreatment zone.

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

Additionally or alternately, a potential high viscosity base stock can be exposed to catalytic dewaxing conditions. Catalytic dewaxing can be used to improve the cold flow properties of a high viscosity base stock, and can potentially also perform some heteroatom removal and aromatic saturation. Suitable dewaxing catalysts can include molecular sieves such as crystalline aluminosilicates (zeolites). In an embodiment, the molecular sieve can comprise, consist essentially of, or be ZSM-5, ZSM-22, ZSM-23, ZSM-35, ZSM-48, zeolite Beta, or a combination thereof, for example ZSM-23 and/or ZSM-48, or ZSM-48 and/or zeolite Beta. Optionally but preferably, molecular sieves that are selective for dewaxing by isomerization as opposed to cracking can be used, such as ZSM-48, zeolite Beta, ZSM-23, or a combination thereof. Additionally or alternately, the molecular sieve can comprise, consist essentially of, or be a 10-member ring 1-D molecular sieve. Examples include EU-1, ZSM-35 (or ferrierite), ZSM-11, ZSM-57, NU-87, SAPO-11, ZSM-48, ZSM-23, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Other molecular sieves that are isostructural with the above materials include Theta-1, NU-10, EU-13, KZ-1, and NU-23. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the disclosure are catalysts with a low ratio of silica to alumina. For example, for ZSM-48, the ratio of silica to alumina in the zeolite can be less than about 200:1, such as less than about 110:1, or less than about 100:1, or less than about 90:1, or less than about 75:1. In various embodiments, the ratio of silica to alumina can be from 50:1 to 200:1, such as 60:1 to 160:1, or 70:1 to 100:1.

In various embodiments, the catalysts according to the disclosure further include a metal hydrogenation component. The metal hydrogenation component is typically a Group VI and/or a Group VIII metal. Preferably, the metal hydrogenation component is a Group VIII noble metal. Preferably, the metal hydrogenation component is Pt, Pd, or a mixture thereof. In an alternative preferred embodiment, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For embodiments where the metal is Pt, Pd, another Group VIII noble metal, or a combination thereof, the amount of metal can be from 0.1 to 5 wt %, preferably from 0.1 to 2 wt %, or 0.25 to 1.8 wt %, or 0.4 to 1.5 wt %. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

The dewaxing catalysts can also include a binder. In some embodiments, the dewaxing catalysts can be formulated using a low surface area binder, where a low surface area binder represents a binder with a surface area of 100 $m^2/g$ or less, or 80 $m^2/g$ or less, or 70 $m^2/g$ or less. The amount of zeolite in a catalyst formulated using a binder can be from about 30 wt % zeolite to 90 wt % zeolite relative to the combined weight of binder and zeolite. Preferably, the amount of zeolite is at least about 50 wt % of the combined weight of zeolite and binder, such as at least about 60 wt % or from about 65 wt % to about 80 wt %.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

Process conditions in a catalytic dewaxing zone in a sour environment can include a temperature of from 200 to 450° C., preferably 270 to 400° C., a hydrogen partial pressure of from 1.8 MPag to 34.6 MPag (250 psig to 5000 psig), preferably 4.8 MPag to 20.8 MPag, and a hydrogen circulation rate of from 35.6 $m^3/m^3$ (200 SCF/B) to 1781 $m^3/m^3$ (10,000 scf/B), preferably 178 $m^3/m^3$ (1000 SCF/B) to 890.6 $m^3/m^3$ (5000 SCF/B). In still other embodiments, the conditions can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF/B to 6000 SCF/B). These latter conditions may be suitable, for example, if the dewaxing stage is operating under sour conditions. The LHSV can be from about 0.2 $h^{-1}$ to about 10 $h^{-1}$, such as from about 0.5 $h^{-1}$ to about 5 $h^{-1}$ and/or from about 1 $h^{-1}$ to about 4 $h^{-1}$.

Additionally or alternately, a potential high viscosity base stock can be exposed to hydrofinishing or aromatic saturation conditions. Hydrofinishing and/or aromatic saturation catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is about 30 wt. % or greater based on catalyst. Suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41. If separate catalysts are used for aromatic saturation and hydrofinishing, an aromatic saturation catalyst can be selected based on activity and/or selectivity for aromatic saturation, while a hydrofinishing catalyst can be selected based on activity for improving product specifications, such as product color and polynuclear aromatic reduction.

Hydrofinishing conditions can include temperatures from about 125° C. to about 425° C., preferably about 180° C. to about 280° C., a hydrogen partial pressure from about 500 psig (3.4 MPa) to about 3000 psig (20.7 MPa), preferably about 1500 psig (10.3 MPa) to about 2500 psig (17.2 MPa), and liquid hourly space velocity from about 0.1 $hr^{-1}$ to about 5 $hr^{-1}$ LHSV, preferably about 0.5 $hr^{-1}$ to about 1.5 $hr^{-1}$. Additionally, a hydrogen treat gas rate of from 35.6 $m^3/m^3$ to 1781 $m^3/m^3$ (200 SCF/B to 10,000 SCF/B) can be used.

Properties of High Viscosity Base Stocks

After exposing a feedstock to coupling reaction conditions, and after any optional catalytic processing, the resulting effluent can be fractionated to form at least a high viscosity base stock product. The high viscosity base stock product can be characterized in a variety of manners to demonstrate the novel nature of the composition.

In the examples described herein, the fractionation of the effluent from the coupling reaction corresponds to a fractionation to separate the parent feed material (lower molecular weight) from the products from the coupling reaction. This can be done, for example, using a short path single stage vacuum distillation, or via any other convenient type of temperature based separator/fractionator. Another fractionation option can be to further fractionate the coupled reaction product to create multiple base stocks, such as making both a heavy neutral and a bright stock range material from the coupled reaction product. Still another option could be to perform a fractionation so that the lightest (i.e., lowest molecular weight) portions of the couple reaction product are separated along with the initial feed. This type of narrower cut portion of the coupled reaction product could provide a higher viscosity base stock from the coupled reaction product but at the cost of a yield debit.

One direct method of characterization of a high viscosity base stock is to use Gel Permeation Chromatography (GPC) to characterize the molecular weight distribution of the high viscosity base stock. GPC is a technique more commonly used for characterization of high molecular weight polymers. However, due to the higher molecular weight distribution of a high viscosity base stock as described herein relative to a conventional bright stock (or other Group I base stock), GPC can be beneficial for illustrating the differences.

Three quantities that can be determined by GPC (or by any other convenient mass characterization method) are polydispersity, $M_w$, and $M_n$, all as defined above.

With regard to a traditional average weight, a high viscosity feedstock can have a number average molecular weight ($M_n$) of 600 g/mol to 3000 g/mol. For example, the number average molecular weight can be 600 g/mol to 3000 g/mol, or 600 g/mol to 2500 g/mol, or 600 g/mol to 2000 g/mol, or 700 g/mol to 3000 g/mol, or 700 g/mol to 2500 g/mol, or 700 g/mol to 2000 g/mol, or 800 g/mol to 3000 g/mol, or 800 g/mol to 2500 g/mol, or 800 g/mol to 2000 g/mol, or 900 g/mol to 3000 g/mol, or 900 g/mol to 2500 g/mol, or 900 g/mol to 2000 g/mol, or 1000 g/mol to 3000 g/mol, or 1000 g/mol to 2500 g/mol, or 1000 g/mol to 2000 g/mol, or 1100 g/mol to 3000 g/mol, or 1100 g/mol to 2500 g/mol, or 1100 g/mol to 2000 g/mol.

Additionally or alternately, a high viscosity feedstock can have a weight average molecular weight ($M_w$) of 900 g/mol to 10000 g/mol. For example, the weight average molecular weight can be 900 g/mol to 10000 g/mol, or 900 g/mol to 9000 g/mol, or 900 g/mol to 8000 g/mol, or 900 g/mol to 7000 g/mol, or 1000 g/mol to 10000 g/mol, or 1000 g/mol to 9000 g/mol, or 1000 g/mol to 8000 g/mol, or 1000 g/mol to 7000 g/mol, or 1200 g/mol to 10000 g/mol, or 1200 g/mol to 9000 g/mol, or 1200 g/mol to 8000 g/mol, or 1200 g/mol to 7000 g/mol, or 1500 g/mol to 10000 g/mol, or 1500 g/mol to 9000 g/mol, or 1500 g/mol to 8000 g/mol, or 1500 g/mol to 7000 g/mol, or 2000 g/mol to 10000 g/mol, or 2000 g/mol to 9000 g/mol, or 2000 g/mol to 8000 g/mol, or 2000 g/mol to 7000 g/mol.

Additionally or alternately, a high viscosity base stock can have an unexpectedly high polydispersity relative to a base stock formed by conventional solvent and/or catalytic processing. The polydispersity can be expressed as $M_w/M_n$. In various aspects, the feedstock can have a polydispersity of at least 1.40, or at least 1.45, or at least 1.50, or at least 1.55, or at least 1.60, or at least 1.65, or at least 1.70, or at least 1.75, or at least 1.80, or at least 1.90, and/or 6.0 or less, or 5.0 or less, or 4.0 or less.

In addition to the above molecular weight quantities, GPC can also be used to quantitatively distinguish a high viscosity base stock from conventional Group I, Group II, and/or Group III base stocks based on the elution time of various components within a sample. The elution time in GPC is inversely proportional to molecular weight, so the presence of peaks at earlier times demonstrates the presence of heavier compounds within a sample. For a conventional base stock formed from a mineral petroleum feed, less than 0.5 wt % of the conventional base stock will elute prior to 23 minutes, which corresponds to a number average molecular weight ($M_n$) of about 3000 g/mol. This reflects the nature of a mineral petroleum sample, which typically contains little or no material having a molecular weight greater than 3000 g/mol. By contrast, the high viscosity base stocks described herein can include substantial amounts of material having a molecular weight ($M_n$) greater than 3000 g/mol, such as a high viscosity base stock having at least about 5 wt % of compounds with a molecular weight greater than 3000 g/mol, or at least about 10 wt %, or at least about 20 wt %, or at least about 30 wt %.

Another characterization method that can provide insight into compositional differences is Quantitative $^{13}C$-NMR. Using $^{13}C$-NMR, the number of epsilon carbons present within a sample can be determined based on characteristic peaks at 29-31 ppm. Epsilon carbons refer to carbons that are at least 5 carbons away from a branch (and/or a functional group) in a hydrocarbon. Thus, the amount of epsilon carbons is an indication of how much of a composition corresponds to wax-like compounds. For a Group I base stock formed by conventional methods, the amount of epsilon carbons can be at least about 25 wt % to 27 wt %. This reflects the fact that typical Group I base stock, particularly a base stock formed by solvent processing, includes a high proportion of wax-like compounds. By contrast, a high viscosity base stock as described herein can have a epsilon carbon content of 23.5 wt % or less, or 23.0 wt % or less, or 22.5 wt % or less, or 22.0 wt % or less, or 21.5 wt % or less. The reduced amount of epsilon carbons is unexpected given the coupling reactions used to form larger compounds for a high viscosity base stock. Without being bound by any particular theory, it is believed that the unexpectedly low epsilon carbon content of a high viscosity base stock can contribute to unexpectedly beneficial low temperature properties, such as pour point, cloud point, and low temperature viscosity.

An example of an unexpectedly beneficial low temperature property can be the crystallization temperature for a high viscosity base stock. Conventional Group I bright stocks can have crystallization temperatures between 0° C. and −10° C., which can pose difficulties with use in certain environments. By contrast, the high viscosity base stocks described herein can have a crystallization temperature of −25° C. or less, or −30° C. or less, or −35° C. or less, or −40° C. or less, or −50° C. or less.

Additionally or alternately, the high viscosity base stocks described herein can have favorable glass transition temperatures relative to a conventional high viscosity base stock. The high viscosity base stocks described herein can have a glass transition temperature of −40° C. or less, or −50° C. or less, or −60° C. or less.

Although the composition of a high viscosity base stock as described herein is clearly different from a conventional Group I base stock, some properties of the high viscosity base stock can remain similar to and/or comparable to a conventional Group I base stock. The density at 15.6° C. of a high viscosity base stock can be, for example, 0.87 g/cm$^3$ to 0.93 g/cm$^3$, which is similar to the density for a conventional Group I bright stock. For example, the density can be 0.87 g/cm$^3$ to 0.93 g/cm$^3$, or 0.87 g/cm$^3$ to 0.92 g/cm$^3$, or 0.88 g/cm$^3$ to 0.93 g/cm$^3$ or 0.88 g/cm$^3$ to 0.92 g/cm$^3$, or 0.89 g/cm$^3$ to 0.93 g/cm$^3$, or 0.89 g/cm$^3$ to 0.92 g/cm$^3$.

Another option for characterizing a high viscosity base stock as described herein relative to a conventional base stock is based on viscosity and/or viscosity index. With regard to viscosity, a convenient value for comparison can be kinematic viscosity at 40° C. or at 100° C. For a conventional Group I base stock, a kinematic viscosity at 40° C. of 460 cSt is desirable for meeting various specifications. Typical values for kinematic viscosity at 40° C. for Group I bright stocks can typically be near 460 cSt. By contrast, high viscosity base stocks as described herein can have kinematic viscosities at 40° C. of at least 600 cSt, or at least 650 cSt, or at least 700 cSt, or at least 800 cSt, or at least 1000 cSt, such as up to 6000 cSt or more. Additionally or alternately, the high viscosity base stocks described herein can have kinematic viscosities at 100° C. of at least 35 cSt, or at least 40 cSt, or at least 50 cSt, or at least 60 cSt, or at least 70 cSt, or at least 85 cSt, or at least 100 cSt, such as up to 1000 cSt or more.

The viscosity index of a high viscosity base stock can also be suitable for use of the high viscosity base stock as a Group I base stock and/or can be higher than the viscosity index range for a Group I base stock. In various aspects, the viscosity index of a high viscosity base stock can be 80 to 150, or 80 to 135, or 80 to 120, or 90 to 150, or 90 to 135, or 90 to 120, or 100 to 150, or 100 to 135, or 100 to 120.

Additionally or alternately, a high viscosity base stock can also have a desirable pour point. In various aspects, the pour point of a high viscosity base stock can be 0° C. or less, or −5° C. or less, or −10° C. or less, or −15° C. or less, or −20° C. or less, and/or down to any convenient low pour point value, such as −60° C. or even lower.

The sulfur and aromatic content of a high viscosity base stock can also be comparable to and/or improved relative to typical values for a Group I base stock or bright stock. For a conventional bright stock, hydroprocessing is not typically performed on the feed during processing because hydroprocessing of sufficient severity to remove sulfur and/or reduce aromatics can also substantially reduce the viscosity of the resulting base stock product. By contrast, the high viscosity base stocks described herein can actually benefit from hydroprocessing (and/or other catalytic processing) of various types. As a result, control of the sulfur content and/or aromatics content of high viscosity base stocks can be provided by selecting appropriate catalytic processing conditions. In various aspects, the sulfur content of a high viscosity base stock can be 1.0 wt % or less, or 0.75 wt % or less, or 0.5 wt % or less, or 0.4 wt % or less, or 0.3 wt % or less, or 0.1 wt % or less, or 0.05 wt % or less, and/or at least 0.01 wt %, or at least 0.03 wt %. With regard to aromatics, the total aromatics in a high viscosity base stock can be about 30 wt % or less, or about 20 wt % or less, or about 15 wt % or less, or about 10 wt % or less, or about 8 wt % or less, and/or at least about 1 wt %, or at least about 3 wt/o, or at least about 5 wt %.

Another way to characterize aromatic content can be based on the relative amount of polynuclear aromatics present in a sample. One potential concern for a base stock formed via coupling reactions can be that the number of polynuclear aromatic cores might be increased. This can be characterized based on UV absorptivity at various wavelengths. The UV absorption at 226 nm roughly corresponds to a total aromatics amount while absorption at 302 nm is indicative of polynuclear aromatic cores. In various aspects, the ratio of UV absorptivity at 302 nm versus UV absorptivity at 226 nm can be 0.20 or less, or 0.18 or less, or 0.16 or less.

Examples of Characterization of High Viscosity Base Stocks

In Examples 1-4 below, a hydrocarbon feed corresponding to a Core 100 Group I base stock was placed in a glass round-bottom flask equipped with a distillation condenser. Additional details regarding the reaction conditions and products from Examples 1-4 are shown in FIG. 9. The feed was first purged with nitrogen and then heated to 150° C. The radical initiator di-tert-butyl peroxide (DTBP, 10-60 wt % relative to weight of base stock in the feed) was added slowly using a syringe pump over a period of 1-4 hours. The decomposition products of DTBP, tert-butanol (major) and acetone (minor), were continuously removed from the reaction mixture by distillation. After completing the addition of DTBP, the reaction mixture was maintained at 150° C. for additional 1-2 hours and then raised to 185° C. for another 1-2 hours. The excess and unreacted feed was first removed from the reaction mixture by vacuum distillation (<0.1 mm Hg or <0.013 kPa, 200° C.). For Examples 2-4, the remaining material was then hydro-finished over a Pd/C catalyst, at 150° C.-200° C. under 500 psig-1000 psig (3.4-6.9 MPag) of hydrogen to yield the final product.

Performing a coupling reaction on a feed corresponding to a Group I base stock and/or a feed suitable for formation of Group I base stocks can produce a product having components of higher molecular weight than a lubricant base stock produced by conventional solvent processing and/or catalytic hydroprocessing. The higher molecular weight product can also have several properties not observed in conventional lubricant base oil products. Without being bound by any particular theory, it is believed that the unusual compositional properties of the high viscosity base stock are related to the ability of the high viscosity base stock to have a high molecular weight while retaining other base stock properties that are usually associated with lower molecular weight compounds.

Table 1 shows various molecular weight related properties for several basestocks. The first row shows properties for Core 2500 (available from ExxonMobil Corporation), which is a conventional Group I Bright Stock formed by solvent processing. The second row shows properties for SpectraSyn™ 40, a polyalphaolefin base stock formed by oligomerization of $C_8$ to $C_{12}$ alpha olefins that is available from ExxonMobil Corporation. Examples 1-4 represent base stocks formed by coupling of a 4 cSt conventional Group I base stock. Example 1 corresponds to a sample that was not hydroprocessed after coupling of the 4 cSt Group I base stock feed. Examples 2-4 are samples of high viscosity basestock as described herein that were hydroprocessed after the coupling reaction. As shown in Table 1 below, increasing the amount of DTBP relative to the amount of base stock feed resulted in a higher molecular weight product.

TABLE 1

Molecular Weight Properties

| Description | Mw* | Mn* | PD* = Mw/Mn | Wt % Eluted before 23 min. (>3000 Mn) |
|---|---|---|---|---|
| Core 2500, Group I Bright Stock | 1163 | 966 | 1.20 | <0.2 |
| SpectraSyn 40, 40 cSt PAO | 2763 | 2188 | 1.27 | 35.6 |
| Example 1 | 1283 | 803 | 1.60 | 4.7 |
| Example 2 | 2240 | 1146 | 1.95 | 24.1 |
| Example 3 | 2123 | 1208 | 1.76 | 20.4 |
| Example 4 | 6239 | 1887 | 3.31 | 56.5 |

For each composition, Table 1 shows the weight average molecular weight, number average molecular weight, polydispersity, and the weight percentage of the composition having a molecular weight greater than 3000 mol/g, as determined based on Gel Permeation Chromatography. The definitions for $M_w$, $M_n$, and polydispersity are provided above. The molecular weights of the samples were analyzed by Gel Permeation Chromatography (GPC) under ambient condition using a Waters Alliance 2690 HPLC instrument fitted with three 300 mm×7.5 mm 5 um PLgel Mixed-D columns supplied by Agilent Technologies. The samples were first diluted with tetrahydrofuran (THF) to ~0.6 w/v % solutions. A 100 uL of the sample solution was then injected onto the columns and eluted with un-inhibited tetrahydrofuran (THF) purchased from Sigma-Aldrich at 1 mL/min flow rate. Two detectors were used, corresponding to a Waters 2410 Refractive Index and a Waters 486 tunable UV detector @ 254 nm wavelength.

As shown in Table 1, the high viscosity base stocks of Examples 2-4 have molecular weights ($M_w$ or $M_n$) that are comparable to or significantly greater than the molecular weight of the polyalphaolefin base stock. By contrast, the base stock of Example 1 has a molecular weight similar to a conventional Group I base stock.

Table 1 also shows the polydispersity for the samples. As shown in Table 1, Examples 2-4 have a polydispersity of greater than 1.75, which indicates an unusually large amount of variation of molecular weights within the sample. By contrast, the conventionally formed Group I bright stock and the polyalphaolefin base stock have polydispersity values below 1.3. It is noted that although Example 1 has apparently conventional Group I base stock values for $M_w$ and $M_n$, the polydispersity for Example 1 of 1.60 is closer to the polydispersity values of Examples 2-4 than to the polydispersity values for either the conventional Group I bright stock or the polyalphaolefin.

The final column in Table 1 shows the weight percent of each sample that eluted prior to 23 minutes (corresponding to 3000 g/mol) during the Gel Permeation Chromatography (GPC) characterization. As noted above, the elution time in GPC is inversely proportional to molecular weight, so the presence of peaks prior to 23 minutes demonstrates the presence of heavier compounds within a sample. The presence of peaks prior to 23 minutes by GPC was selected as a characteristic due to the fact that conventional mineral petroleum sources do not typically contain compounds of this molecular weight. This is shown for the conventional Group I base stock in Table 1, where the weight percent that elutes before 23 minutes is less than 0.2 wt %. This clearly shows the contrast between a conventional Group I base stock and the high viscosity base stocks described herein, as compounds are present within the high viscosity base stocks that are simply not present within a conventional Group I base stock. Further details regarding the GPC characterization of each sample are shown in FIG. 8, which shows the full characterization results.

Figure 8:
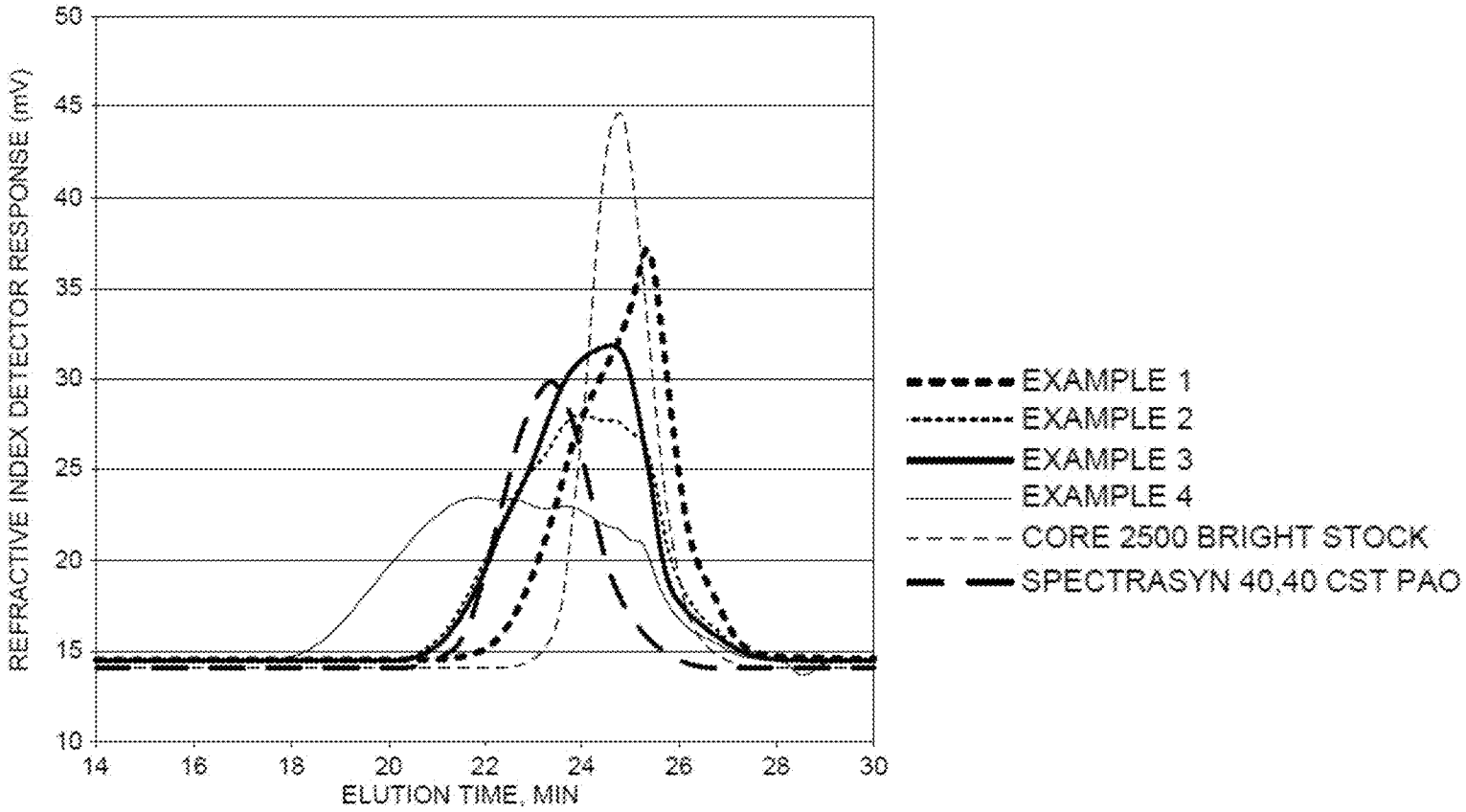
FIG. 8 shows Gel Permeation Chromatography results for various base stock samples.

As shown in Table 1 and FIG. 8, performing a coupling reaction using a Group I base stock as a feed can generate compositions with unusual molecular weight profiles. The novelty of these high viscosity compositions can be further understood based on the properties of the compositions. FIG. 9 shows a variety of physical and chemical properties for the high viscosity base stocks from Examples 1-4 in comparison with the conventional CORE 2500 Group I bright stock.

In FIG. 9, the first two properties shown correspond to kinematic viscosity at 40° C. and 100° C. The viscosity values for the conventional Group I base stock are representative of expected values for a bright stock formed by solvent processing. Example 1 which was not hydroprocessed has kinematic viscosities that are somewhat higher but comparable to a conventional Group I bright stock. By contrast, Examples 3 and 4 show substantially increased kinematic viscosities, with kinematic viscosities at 100° C. of greater than 100 cSt and greater than 3000 at 40° C.

Although Examples 3 and 4 have unexpectedly high viscosities, the viscosity index of the high viscosity base stocks in Examples 2-4 is also favorable relative to a conventional base stock. Examples 2 and 3 both have viscosity index values greater than 100, while Example 4 has a viscosity index value that could actually correspond to a Group III bright stock if the sulfur content was lower. It is noted that even though Example 1 was not hydroprocessed, the viscosity index is still sufficiently high for Example 1 to correspond to a Group I bright stock.

The next property in FIG. 9 is density. Conventionally, the density of an oligomerized base stock might be expected to increase relative to the density of the individual compounds used to form the oligomer. In contrast, the formation of high molecular weight compounds in the base stocks in Examples 2-4 has not resulted in a substantial density increase. Instead, the density of the high viscosity base stocks in Examples 2-4 is comparable to the density of the conventional Group I base stock. (Example 2 actually has a lower density than the comparative Group I bright stock.) Lower densities are desirable for base stocks as lower density usually correlates with improved energy efficiency.

The high viscosity base stocks in Examples 2-4 can also have a favorable sulfur content relative to a conventional bright stock. The conventional Group I base stock in FIG. 9 has a typical sulfur value for a bright stock of about 1 wt % (determined according to ASTM D2622-1). By contrast, the high viscosity base stocks in Examples 2-4 actually benefit from hydroprocessing. This can allow reduction of sulfur to a desired level. This reduced level of sulfur can be beneficial, as at least some lubricant formulations are sensitive to sulfur level.

The high viscosity base stocks described herein can also be characterized based on aniline point. As shown for Examples 2-4, the hydroprocessing of the high viscosity base stock resulted in a product with a higher aniline point than a conventional Group I bright stock. Examples 2-4 each have an aniline point of at least 125° C. (determined according to ASTM D611).

The next two properties in FIG. 9 are glass transition temperature and crystallization temperature, as determined using differential scanning calorimetry. The glass transition temperature of the high viscosity base stocks described herein is comparable to the glass transition temperature for a conventional Group I bright stock. However, the crystallization temperature for the high viscosity base stocks is unexpectedly superior to a conventional Group I bright stock. As shown in FIG. 9, the conventional Group I bright stock has a crystallization temperature between 0° C. and −10° C. By contrast, the high viscosity base stocks of Examples 2-4 having crystallization temperatures of −35° C. or lower. This is a substantial improvement in cold flow properties, and indicates that the high viscosity base stocks can have superior values for properties such as pour point and/or cloud point. The improved cold flow properties are particularly unexpected in view of the substantially higher viscosities of Examples 3 and 4.

The final two properties in FIG. 9 are properties determined by $^{13}$C-NMR. One property is the percentage of epsilon carbons in the sample, which corresponds to a characteristic peak at 29-31 ppm. Epsilon carbons are carbons that are 5 carbons removed from a branch (and/or a functional group) in a hydrocarbon or hydrocarbon-like compound. Such epsilon carbons are indicative of the presence of long waxy chains within a sample. Although long waxy chains are commonly present in conventional lubricant base stocks, increased amounts of such long waxy chains typically correlate with less favorable values in cold flow properties such as pour point or cloud point. The conventional Group I bright stock in Table 2 has a typical value for epsilon carbons of about 27 wt %. Although the molecular weights of the samples in Examples 2-4 are substantially higher, the percentage of epsilon carbons is less than 22 wt % for all of the samples. The non-hydroprocessed sample of Example 1 also has an epsilon carbon amount of less than 22 wt %.

The $^{13}$C-NMR can also be used to determine the amount of aromatic carbons in a sample, based on peaks between 117 ppm and 150 ppm. In spite of hydroprocessing, the amount of aromatic carbons in Examples 2 and 3 is actually greater than the amount of aromatics in the conventional Group I bright stock.

One potential concern for a base stock formed via coupling reactions can be that the number of polynuclear aromatic cores might be increased. However, the high viscosity base stocks in Examples 1 to 4 show no increase in the amount of polynuclear aromatic cores relative to a conventional Group I bright stock. FIG. 10 shows a comparison of the UV absorptivity of the conventional Group I bright stock and Examples 1 to 4 at various wavelengths. The UV absorption at 226 nm roughly corresponds to a total aromatics amount while 302 nm is indicative of polynuclear aromatic cores. As shown in FIG. 10, the ratio of PNAs to total aromatics for the high viscosity base stocks is comparable to the value for the conventional Group I bright stock.

Example 5: Lubricant Formulation—Gear Oil Properties

In addition to the above physical and chemical properties, high viscosity base stocks can provide other types of improved properties. In this Example, the high viscosity base stock corresponding to Example 3 was used to formulate an ISO VG 220 gear oil. An ISO VG 220 gear oil was also formulated using the conventional CORE 2500 Group I bright stock. The same amount of the same additive package and the same rebalancing light neutral base stock were used for both gear oils to make the required viscosity grade. Two formulation performance features were measured. One measured feature was low temperature properties using ASTM test method D2983, Brookfield viscosity at −20° C. A second measured feature was oxidation stability using US Steel S-200 at 121° C. for 13 days.

Figure 11:
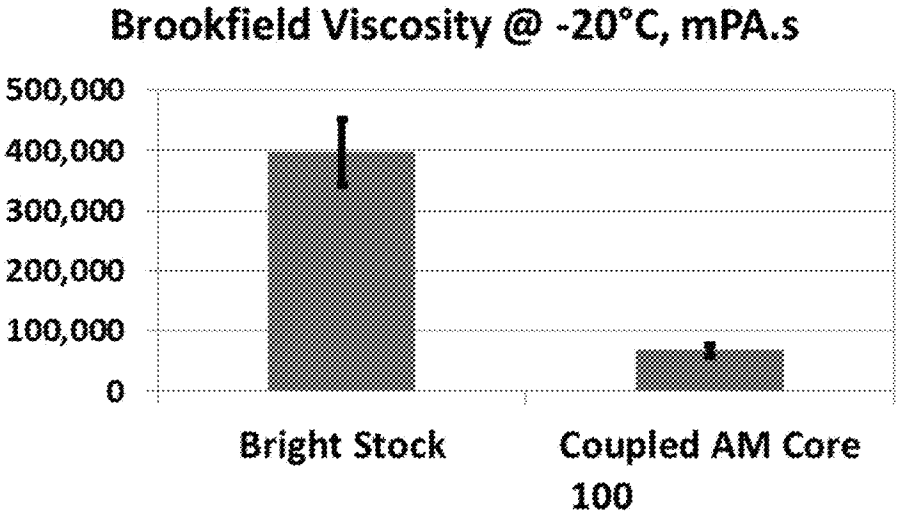
FIG. 11 shows Brookfield viscosity data for lubricants formulated using various base stocks.

FIG. 11 shows a comparison of the Brookfield viscosity at −20° C. for the gear oil formulated using the conventional Group I bright stock and the gear oil formulated using the high viscosity base stock of Example 3. As shown in FIG. 11, the gear oil formulated using Example 3 has a Brookfield viscosity of less than 100,000, while the gear oil formulated using the conventional bright stock has a substantially higher viscosity. As shown in Table 2, it is noted that the crystallization temperature of the conventional bright stock is higher than −20° C., which likely contributes to the high viscosity. The lower crystallization temperature of the high viscosity base stock of Example 3 allows the formulated gear oil to retain a desirable viscosity at low temperatures.

Figure 12:
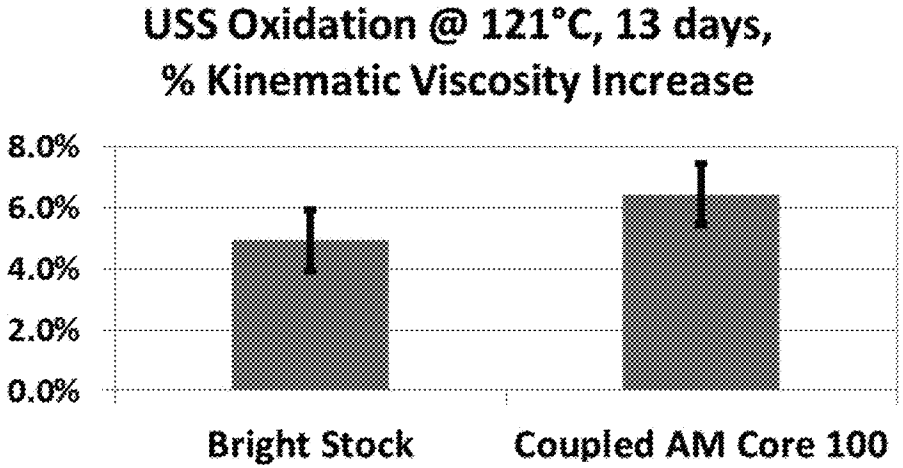
FIG. 12 shows oxidation induced changes in kinematic viscosity for lubricants formulated using various base stocks.

FIG. 12 shows results from performing the US Steel oxidation test on the gear oils formulated using the conventional bright stock and the high viscosity base stock of Example 3, respectively. Conventionally, a gear oil formulated using a higher molecular weight base stock would be expected to perform less favorably under this severe oxidation test. However, in spite of the substantially higher molecular weight, the gear oil formulated using the high viscosity base stock of Example 3 had a comparable degree of oxidation (similar to within the experimental error of the method) to the gear oil formulated using the conventional bright stock.

Example 6: Lubricant Formulation—Gear Oil Properties

In this Example, the high viscosity base stock corresponding to Example 3 was used to formulate an ISO VG 220 gear oil. A second ISO VG 220 gear oil was also formulated using the conventional CORE 2500 Group I bright stock. The same amount of the same additive package and the same rebalancing light neutral base stock were used for the formulated gear oils to make the required viscosity grade. Two formulation performance features were measured. One measured feature was low temperature properties using ASTM test method D2983, Brookfield viscosity at −35° C. A second measured feature was oxidation stability using ASTM test method D2272, the Rotating Pressure Vessel Oxidation Test (RPVOT) at 150° C.

Figure 13:
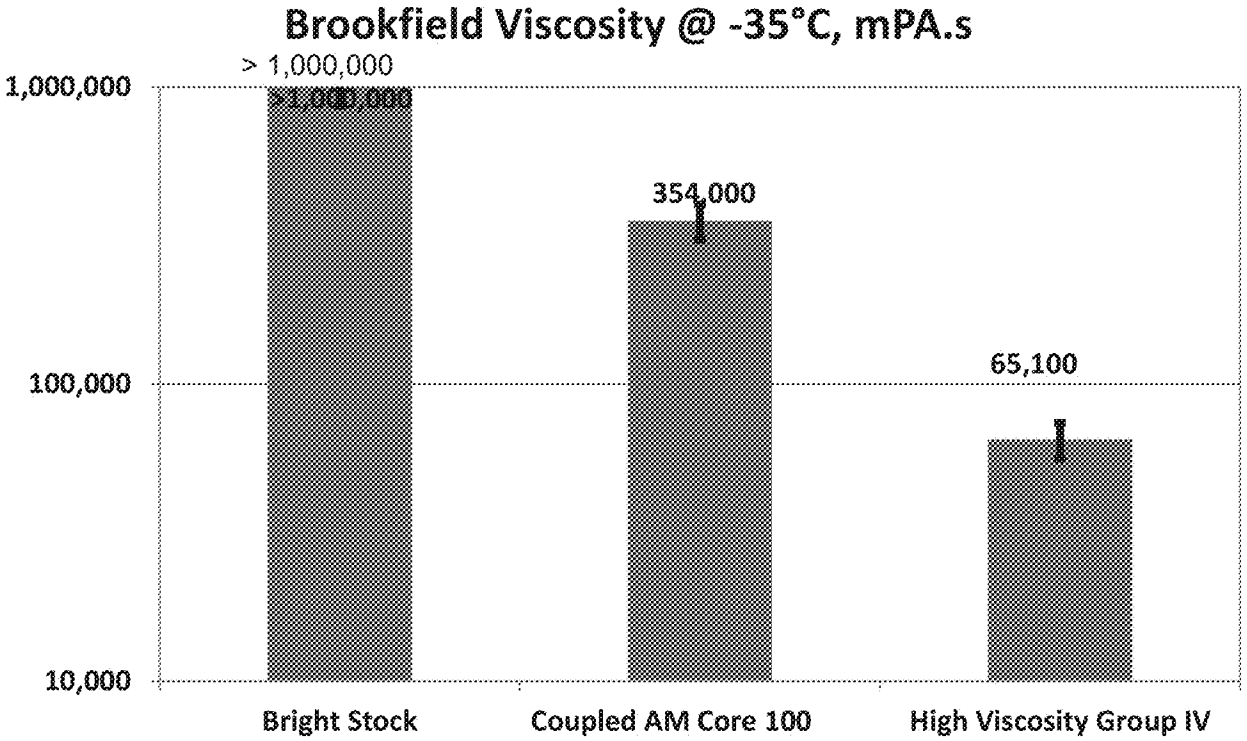
FIG. 13 shows Brookfield viscosity data for lubricants formulated using various base stocks.

FIG. 13 shows a comparison of the Brookfield viscosity at −35° C. for the gear oil formulated using the conventional Group I bright stock, the gear oil formulated using the high viscosity base stock of Example 3, and a gear oil formulated using a polyalphaolefin (high viscosity Group IV) base stock. As shown in FIG. 13, the gear oil formulated using Example 3 has a Brookfield viscosity at −35° C. of about 350,000, while the gear oil formulated using the conventional bright stock has a Brookfield viscosity at −35° C. that exceeds the test limit of 1,000,000. As in Example 5, formulating a gear oil using the high viscosity base stocks described herein provides superior low temperature performance relative to a conventional Group I bright stock. In FIG. 13, it is not surprising that the gear oil formulated using the Group IV base stock provides a still lower Brookfield viscosity at −35° C.

Figure 14:
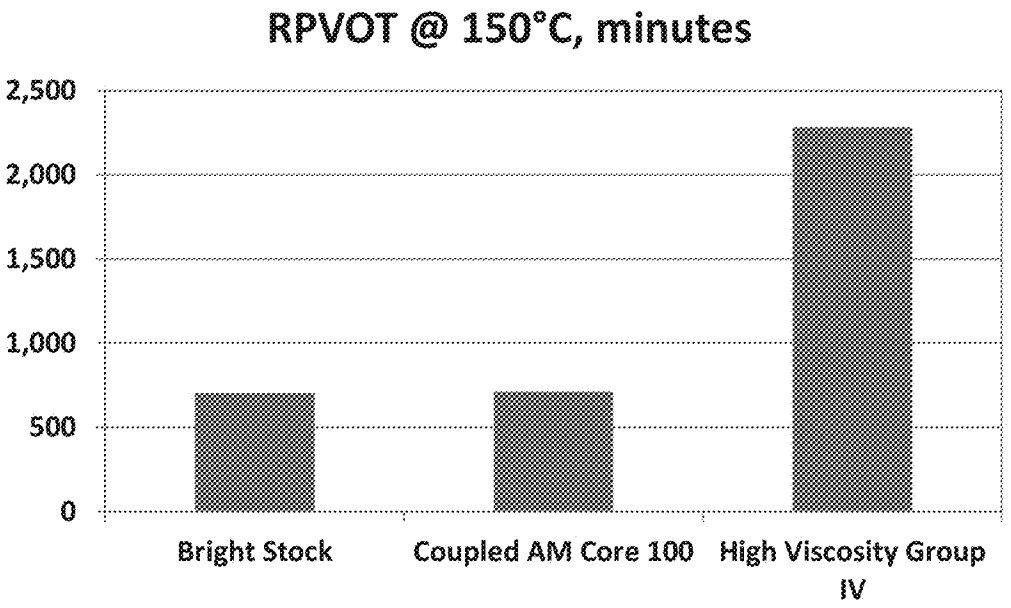
FIG. 14 shows RPVOT data for lubricants formulated using various base stocks.

FIG. 14 shows results from a Rotating Pressure Vessel Oxidation Test (RPVOT), a demanding test for assessing highly stable gear oils, that was performed on gear oils formulated using the same types of base stocks as in FIG. 13.

In the RPVOT oxidation stability test, the gear oil formulated using the high viscosity base stock of Example 3 performed similarly (within experimental error of the test) to the gear oil formulated using the traditional bright stock. This comparable performance is achieved despite a higher molecular weight, which is conventionally believed to be detrimental to oxidation stability. As expected, both of the gear oils formulated using Group I base stocks show poorer performance compared to the Group IV based formulation.

ADDITIONAL EMBODIMENTS

Embodiment 1

A base stock composition having a number average molecular weight ($M_n$) of 600 g/mol to 3000 g/mol, a weight average molecular weight ($M_w$) of 900 g/mol to 10000 g/mol, a polydispersity ($M_w/M_n$) of at least 1.4, a pour point of 0° C. or less, a viscosity at 100° C. of at least 35 cSt, a viscosity at 40° C. of at least 600 cSt, and a viscosity index of at least 50.

Embodiment 2

The composition of Embodiment 1, wherein the polydispersity is at least 1.5, or at least 1.7, or at least 1.9, and optionally less than 5.0, or less than 4.0.

Embodiment 3

The composition of any of the above embodiments, wherein the composition has 23.5 wt % or less of epsilon carbons as determined by $^{13}$C-NMR, or 23.0 wt % or less, or 22.5 wt % or less, or 22.0 wt % or less.

Embodiment 4

The composition of any of the above embodiments, wherein the number average molecular weight ($M_n$) is at least 900 g/mol, or at least 1000 g/mol; or wherein the weight average molecular weight ($M_w$) is at least 1200 g/mol, or at least 1500 g/mol, or at least 2000 g/mol; or a combination thereof.

Embodiment 5

The composition of any of the above embodiments, wherein the composition has a glass transition temperature of −40° C. or less, or −50° C. or less, or −60° C. or less; or wherein the composition has a crystallization temperature of −20° C. or less, or −30° C. or less, or −40° C. or less; or a combination thereof.

Embodiment 6

The composition of any of the above embodiments, wherein the composition has a sulfur content of 0.5 wt % or less, or 0.4 wt % or less.

Embodiment 7

The composition of any of the above embodiments, wherein the composition has a) a kinematic viscosity at 40° C. of at least 700 cSt, or at least 800 cSt, or at least 1000 cSt; b) a kinematic viscosity at 100° C. of at least 40 cSt, or at least 50 cSt, or at least 60 cSt, or at least 70 cSt; or c) a combination thereof.

Embodiment 8

The composition of any of the above embodiments, wherein the viscosity index is at least 80, or at least 90, or at least 100, and/or 150 or less, or 135 or less, or 120 or less.

Embodiment 9

The composition of any of the above embodiments, wherein the composition has a ratio of UV absorptivity at 302 nm versus UV absorptivity at 226 nm of 0.20 or less, or 0.18 or less.

Embodiment 10

A formulated lubricant comprising the base stock composition of any of the above embodiments.

Embodiment 11

A method of forming a base stock composition, comprising: introducing a feedstock having a viscosity index of 50 to 120, a viscosity at 100° C. of 12 cSt or less, and at least one of a sulfur content greater than 0.03 wt % and an aromatics content greater than 10 wt %, into a coupling reaction stage under effective coupling conditions to form a coupled effluent; and fractionating at least a portion of the coupled effluent to form at least a first product fraction having a viscosity index of at least 50, a polydispersity ($M_w/M_n$) of at least 1.4, a viscosity at 100° C. of at least 35 cSt, a viscosity at 40° C. of at least 600 cSt, and a pour point of 0° C. or less.

Embodiment 12

The method of Embodiment 11, further comprising exposing at least a portion of the coupled effluent to a catalyst under effective catalytic processing conditions to form a catalytically processed effluent, wherein fractionating at least a portion of the coupled effluent comprises fractionating at least a portion of the catalytically processed effluent.

Embodiment 13

A method of forming a base stock composition, comprising: introducing a feedstock having a viscosity index of 50 to 120, a viscosity at 100° C. of 12 cSt or less, and at least one of a sulfur content greater than 0.03 wt % and an aromatics content greater than 10 wt %, into a coupling reaction stage under effective coupling conditions to form a coupled effluent; fractionating at least a portion of the coupled effluent to form at least a first coupled effluent fraction; and exposing at least a portion of the first coupled effluent fraction to a catalyst under effective catalytic processing conditions to form the first product fraction having a viscosity index of at least 50, a polydispersity ($M_w/M_n$) of at least 1.4, a viscosity at 100° C. of at least 35 cSt, a viscosity at 40° C. of at least 600 cSt, and a pour point of 0° C. or less.

Embodiment 14

The method of any of Embodiments 11-13, wherein the effective catalytic processing conditions comprises at least one of hydrotreatment conditions, catalytic dewaxing conditions, and hydrofinishing conditions.

Embodiment 15

The method of any of Embodiments 11-14, wherein the effective coupling conditions comprise exposing the feedstock to at least 20 wt % dialkyl peroxide relative to a combined weight of feedstock and peroxide, or at least 30 wt %, or at least 40 wt %.

Embodiment 16

The method of any of Embodiments 11-14, wherein the effective coupling conditions comprise acid-catalyzed coupling conditions, the acid optionally comprising a solid acid, preferably a molecular sieve.

When numerical lower limits and numerical upper limits are listed herein, ranges from any lower limit to any upper limit are contemplated. Although the present disclosure has been described in terms of specific embodiments, it is not so limited. Suitable alterations/modifications for operation under specific conditions should be apparent to those skilled in the art. It is therefore intended that the following claims be interpreted as covering all such alterations/modifications as fall within the true spirit/scope of the disclosure.

The invention claimed is:

1. A base stock composition comprising a hydroprocessed base stock having a number average molecular weight ($M_n$) of 600 g/mol to 3000 g/mol, a weight average molecular weight ($M_w$) of 900 g/mol to 10000 g/mol, a polydispersity ($M_w/M_n$) of at least 1.4, a pour point of 0° C. or less, a kinematic viscosity at 100° C. of at least 35 cSt, a kinematic viscosity at 40° C. of at least 600 cSt, and a viscosity index of at least 50, with the proviso that the hydroprocessed base stock is not a polyalphaolefin (PAO).

2. The composition of claim 1, wherein the polydispersity is at least 1.7.

3. The composition of claim 1, wherein the composition has 23.5 wt % or less of epsilon carbons as determined by $^{13}$C-NMR.

4. The composition of claim 1, wherein the number average molecular weight ($M_n$) is at least 900 g/mol.

5. The composition of claim 1, wherein the weight average molecular weight ($M_w$) is at least 1500 g/mol.

6. The composition of claim 1, wherein the composition has a glass transition temperature of −40° C. or less; or wherein the composition has a crystallization temperature of −20° C. or less; or a combination thereof.

7. The composition of claim 1, wherein the composition has a sulfur content of 0.5 wt % or less.

8. The composition of claim 1, wherein the composition has a) a kinematic viscosity at 40° C. of at least 700 cSt; b) a kinematic viscosity at 100° C. of at least 40 cSt; or c) a combination thereof.

9. The composition of claim 1, wherein the viscosity index is at least 80.

10. The composition of claim 1, wherein the viscosity index is at least 100.

11. The composition of claim 1, wherein the viscosity index is at least 50 and equal to or less than 150.

12. The composition of claim 1, further comprising at least one additive for forming a formulated lubricant base oil.

* * * * *